US006915845B2

(12) United States Patent
Leising et al.

(10) Patent No.: US 6,915,845 B2
(45) Date of Patent: Jul. 12, 2005

(54) RE-ENTERABLE GRAVEL PACK SYSTEM WITH INFLATE PACKER

(75) Inventors: Lawrence J. Leising, Missouri City, TX (US); Arthar M. Ali, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 127 days.

(21) Appl. No.: 10/444,818

(22) Filed: May 23, 2003

(65) Prior Publication Data

US 2003/0221830 A1 Dec. 4, 2003

Related U.S. Application Data

(60) Provisional application No. 60/386,139, filed on Jun. 4, 2002.

(51) Int. Cl.[7] ..... E21B 42/12

(52) U.S. Cl. ..... 166/117.6; 166/313; 166/380

(58) Field of Search ..... 166/50, 117.5, 166/117.6, 313, 380

(56) References Cited

U.S. PATENT DOCUMENTS

| | | | | |
|---|---|---|---|---|
| 3,439,740 A | | 4/1969 | Conover | |
| 3,575,238 A | | 4/1971 | Shillander | |
| 4,316,504 A | | 2/1982 | Baker et al. | |
| 4,345,648 A | | 8/1982 | Kuus | |
| 4,655,292 A | | 4/1987 | Halbardier | |
| 4,711,301 A | | 12/1987 | Stringfellow | |
| 4,877,086 A | | 10/1989 | Zunkel | |
| 5,033,550 A | * | 7/1991 | Johnson et al. | 166/372 |
| 5,373,906 A | * | 12/1994 | Braddick | 175/67 |
| 6,012,527 A | * | 1/2000 | Nitis et al. | 166/313 |
| 6,073,692 A | | 6/2000 | Wood et al. | |
| 6,164,378 A | | 12/2000 | Coronado | |
| 6,202,748 B1 | | 3/2001 | Carisella et al. | |
| 6,209,648 B1 | * | 4/2001 | Ohmer et al. | 166/313 |
| 6,213,217 B1 | | 4/2001 | Wilson et al. | |
| 6,289,994 B1 | | 9/2001 | Willauer | |
| 6,305,477 B1 | | 10/2001 | Carisella et al. | |
| 6,341,654 B1 | | 1/2002 | Wilson et al. | |
| 6,543,536 B2 | * | 4/2003 | Dewey et al. | 166/255.2 |

* cited by examiner

*Primary Examiner*—Frank Tsay
(74) *Attorney, Agent, or Firm*—Wayne Kanak; Tim Curington; Robin Nava

(57) ABSTRACT

A gravel packing system for re-entry of a screen assembly by a completion tool having an inflate packer as an isolation barrier for minimizing the necessary height of the gravel pack within the casing and thus maximizing the production interval of a well to permit a higher rate of production. The invention assures re-entry of tools to a gravel pack screen assembly for well completion following a gravel pack operation. A guiding and anchoring tool is run through a casing restriction and/or well tubing to a desired position below the restriction and/or tubing and within the casing and is actuated for anchoring. Guide fingers are formed downhole into a tool guiding configuration and the tool is left anchored within the well casing. Subsequently, a well completion tool is and guided into and latched within the guiding and anchoring tool and the inflate packer is set to enable optimum well production.

42 Claims, 9 Drawing Sheets

RE-ENTERABLE GRAVEL PACK SYSTEM WITH INFLATE PACKER

CROSS-REFERENCE TO RELATED APPLICATIONS

This application claims priority from U.S. Provisional Application No. 60/386,139, filed Jun. 4, 2002, which is incorporated herein by reference.

BACKGROUND OF THE INVENTION

1. Field of the Invention

The invention relates generally to well servicing operations, such as gravel packing operations to complete wells for production operations and to enhance the productivity thereof. More particularly, the present invention concerns a re-enterable well servicing system that is effective for gravel packing operations, gravel washing operations, and other downhole activities. The present invention also concerns a guiding tool that is conveyed through tubing and into a well casing and incorporates a plurality of guide fingers that are formed in the downhole environment to a guiding receptacle configuration to ensure re-entry of well servicing tools throughout the productive period of a well. From the standpoint of gravel packing operations, the guiding tool is connected with a blank pipe and screen assembly, and an inflate packer is set immediately above a gravel column of limited height to permit a production interval of greater height to be produced and thus permit a greater rate of production from the production interval.

2. Description of Related Art

With conventional vent screen gravel packs, a long annular area of a well is filled with gravel (sand), with the gravel serving to permit the flow of production gas through the gravel and through a through tubing gravel pack (TTGP) screen and into a vent pipe where the flowing gas is conducted above the gravel pack and to the production tubing of the well. The height of the column of gravel in the annulus must be sufficiently great to prevent gas migration through the gravel in the annulus between the well casing and the vent pipe so that production flow occurs only through the gravel pack screen and vent pipe to the production tubing string. The typically significant height of the gravel column in gravel pack well completions limits production capability and also causes the potential loss of a large productive interval (typically 150 feet) since the completions are not retrievable.

If the height of the gravel pack column above the TTGP screen and above the casing perforations is insufficient, i.e., less than about 150 feet, and the well is produced at a relatively high flow rate, the gravel (sand) that is located within the annulus between the TTGP screen and the vent pipe and the well casing will not completely isolate the gas pressure of the productive formation. Rather, the gas will migrate through the gravel column and will entrain some of the gravel, thus carrying it upwardly into the production tubing. In this manner, some of the gravel is produced along with the flowing gas, thus reducing the height of the gravel column and interfering with the productive capability of the well.

BRIEF SUMMARY OF THE INVENTION

It is a principal feature of the present invention to provide a novel gravel pack procedure that employs an inflate packer to seal the annulus between the blank pipe and the well casing immediately above the gravel pack column, thus minimizing the necessary height of the gravel pack column and positively preventing any migration of produced gas through the gravel and also preventing any loss of the gravel of the gravel pack column regardless of the gas production flow rate that is permitted.

It is another feature of the present invention to provide a novel gravel pack system employing a centralizing, guiding, and anchoring assembly having the capability, after having been set within a well casing, to permit the conduct of a gravel pack operation while excluding gravel from the screen below the blank pipe and to permit ensured re-entry of a well servicing tool into a guiding tool left in the casing during a previous operation.

It is a further feature of the present invention to run a guiding tool or a guiding and anchoring tool through well tubing and into a well casing, or through a restriction in a well casing, and to substantially permanently spread multiple guide fingers of the tool, in the downhole environment, to form a funnel shaped guide structure with ends of the guide fingers in guiding relation with the well casing for guiding subsequently run well servicing tools into a tool receptacle of the guiding tool.

It is also a feature of the present invention to provide a novel gravel pack system having an anchor device mounted above a blank pipe and production screen, with a burst disk or other frangible barrier isolating the interior of the gravel pack screen, so that it will not be filled with gravel during gravel packing, and with the frangible barrier being cut in a subsequent operation with a completion tool string having a cutting muleshoe to communicate the screen and vent pipe with the production tubing to permit production of the well.

It is an even further feature of the present invention to provide a novel gravel pack system having a running tool and anchor assembly having a burst disk for isolating the interior of a production screen and having a polished bore and latch profile above the burst disk to enable well service tools, such as a gravel washing tool and a completion tool with an inflate packer, to be run into the tool receptacle of the anchor tool assembly. The completion tool will cut or otherwise perforate the burst disk to complete the gravel pack production assembly and the inflate packer will effectively seal the annulus above a gravel column of minimal height and permit production of the well at high flow rates without any risk of producing gravel from the gravel pack column.

It is another feature of the present invention to provide a novel inflation pressure compensation system for an inflate packer to compensate for pressure and temperature variations during production and to compensate for pressure changes due to formation pressure drawdown, and thus minimize the potential for excessive inflation pressure which might otherwise damage the inflate packer. It is another feature of the present invention to provide a novel gravel pack system having a running tool provided with a collet disconnect, with the collet disconnect designed both for pull testing and for achieving controlled separation of the coiled tubing deployment system from the running tool.

Briefly, one aspect of the present invention concerns a guiding tool having a tool receptacle and a plurality of elongate guide fingers which is run into a well through a tubing string and, after leaving the tubing string and entering the well casing, is formed in the downhole environment to a tool guiding configuration. The guiding tool is run into the well with the elongate guide fingers in collapsed condition to permit running of the tool through well tubing, and incorporates a swage member that engages reaction portions of the guide fingers and is moved to spread the guide fingers to a generally funnel-shaped tool guiding configuration with the outer ends of the guide fingers in guiding relation with the well casing.

Another aspect of the present invention comprises isolating the annulus between blank pipe and the production casing/liner on top of a gravel pack screen and blank pipe assembly using an inflate packer, which seals between the tool string and the casing immediately above the gravel pack column of the well. The inflate packer prevents gas flow in the annulus between the well service tool and the casing and allows higher drawdown and production rates without any risk of producing gravel, makes the gravel pack completion more tolerant to pressure surges, eliminates the need for a "vent" screen, and reduces the amount of blank pipe that is required to complete a given production zone. The inflate packer also minimizes the length or height of the gravel column and thus maximizes the production interval of the well that is possible and thus enhances the productivity of the interval being produced.

After a gravel packing operation has been completed, the completion tool string of the present invention also provides for efficient cleaning of excess gravel from the well and from the tool passage of the guide and anchor assembly above an imperforate frangible panel of a burst disk element or frangible barrier which isolates the interior of the gravel pack screen assembly from the tool passage of the guiding and anchoring assembly. The completion tool string may also incorporate a cutting muleshoe that is actuated or moved to cut the frangible barrier and communicates a production flow passage with the blank pipe and the gravel pack screen, to thus prepare the well for production.

BRIEF DESCRIPTION OF THE DRAWINGS

The present invention may be understood by reference to the following description taken in conjunction with the accompanying drawings in which.

DETAILED DESCRIPTION OF THE INVENTION

Figure 1A:
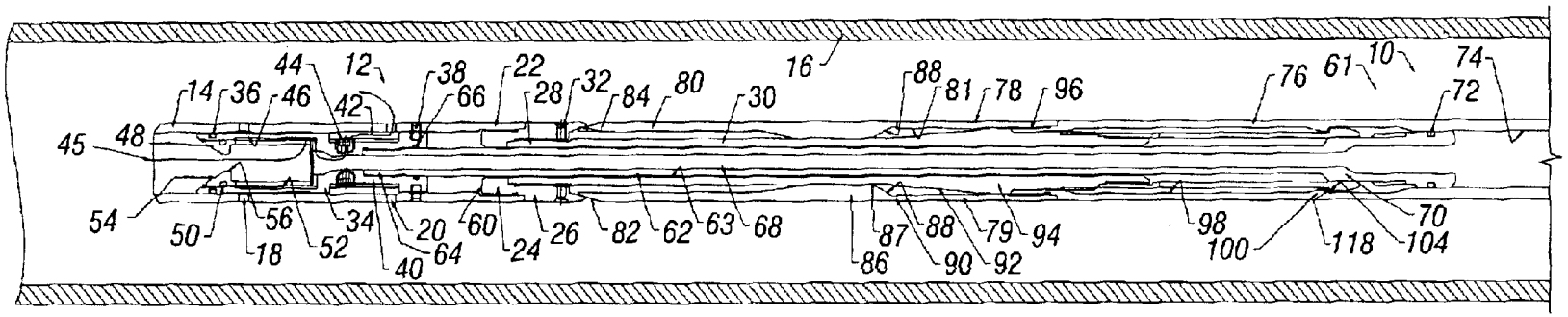
FIGS. 1A and 1B are longitudinal sectional views illustrating, respectively, the upper and lower portions of a guiding and anchoring tool embodying the principles of the present invention and showing the guiding and anchoring features of the tool in collapsed configuration for running through well tubing and into a well casing in readiness for setting thereof within the casing.
Figure 1B:
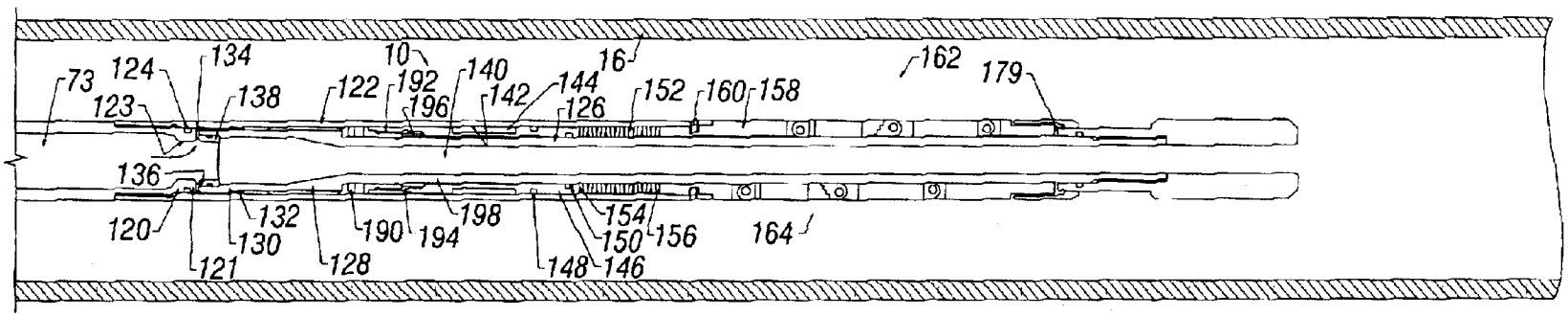

Referring now to the drawings and first to FIGS. 1A and 1B, a centralizing, guiding and anchoring tool or apparatus is shown generally at 10 and is provided at its upper end with a running tool shown generally at 12. The running tool 12 has a tubular housing 14 that is adapted for connection with a tubing connector, not shown, for running the guiding and anchoring tool 10 on a tubing string, such as a coiled tubing string, into a well and positioning the guiding and anchoring tool 10 in a desired location within a well casing 16. The tubular housing 14 defines a plurality of upper flow ports 18 and a plurality of lower flow ports 20 through which clean circulating fluid flow selectively occurs as shown by flow arrows 45 in FIGS. 1A and 2A. The tubular housing 14 of the running tool 12 defines an internally threaded section 22 into which is threadedly received the externally threaded section 24 of a retainer element 26. The retainer element 26 is also internally threaded and establishes threaded connection with the upper end section 28 of an elongate tubular forming mandrel 30. To ensure the integrity of the threaded connection of the tubular forming mandrel 30 and the retainer element 26, one or more locking elements 32, such as set screws, are positioned to prevent relative rotation of the tubular forming mandrel 30 and the retainer element 26.

It is intended that fluid be caused to flow through the running tubing during running and installation of the guiding and anchoring tool 10 since coiled tubing is the running tubing of choice. The presence of pressurized fluid within the coiled tubing adds sufficient structural integrity to prevent coiled tubing from buckling or collapsing due to the insertion force being applied to the tubing during tool running operations, especially if the well is highly deviated or horizontal at any of its sections. A tubular orifice mounting member 34 is positioned within the tubular housing 14 and is sealed with respect to the inner cylindrical wall surface of the tubular housing 14 by an O-ring seal 36. The tubular orifice mounting member 34 is releasably retained at the position shown in FIGS. 1A and 2A by one or more shear pins 38 that are received within registering shear pin receptacles of the tubular housing 14 and the tubular orifice mounting member 34. A tubular intermediate section 40 of the tubular orifice mounting member 34 is of reduced diameter, as compared with the outer diameter of the tubular orifice mounting member 34, and thus is spaced from the inner cylindrical wall surface of the tubular housing 14 and defines a fluid flow annulus 42 that, in the position shown in FIG. 1A, is in communication with the lower flow port or ports 20. One or more diverter plug members 44 are releasably secured to the tubular intermediate section 40 of the tubular orifice and seat mounting member 34 and define flow passages that are in registry with flow ports that are defined in the reduced diameter intermediate section 40 of the tubular orifice and seat mounting member 34. Though the diverter plug members 44 are retained in any suitable manner, preferably they are threaded into internally threaded receptacles of the reduced diameter intermediate section 40 and sealed with respect thereto by O-ring seals as shown. The flow ports or orifices of the diverter plugs 44 are offset with respect to the location of the lower ports 20, thus causing the flow path to be in the form of a gentle S-curve, rather than impinging directly against an opposing mandrel or casing surface. The diverter plugs 44 are fabricated from a material that erodes at a prescribed rate as the abrasive slurry flows through the flow ports or orifices thereof. This controlled erosion of the diverter plugs 44 more evenly distributes the erosion damage on the outer mandrel ports to increase component life. When the diverter plugs 44 become worn or eroded to the point that replacement is desirable, the worn diverter plugs 44 are simply unthreaded from their receptacles and are replaced with new diverter plugs.

Figure 2A:
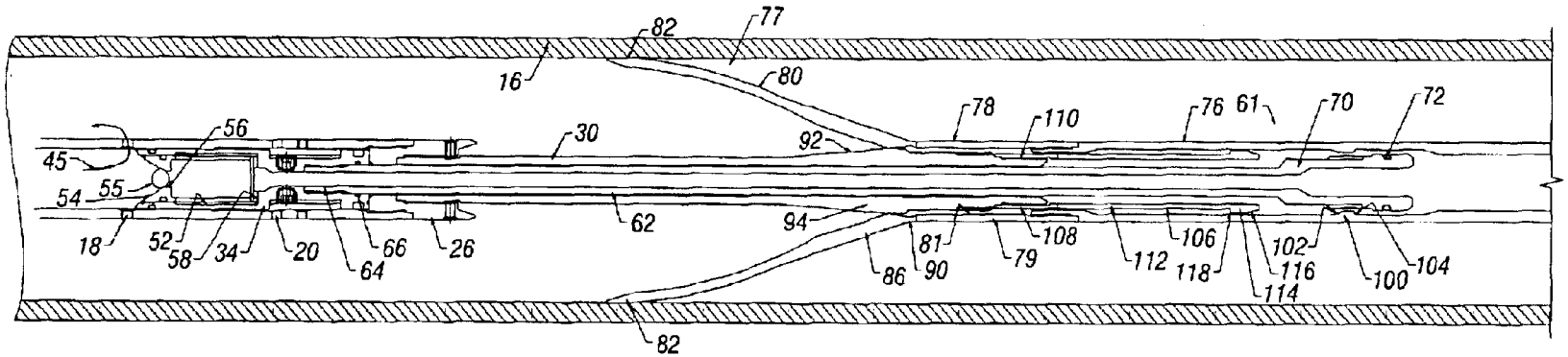
FIGS. 2A and 2B are also longitudinal sectional views illustrating, respectively, the upper and lower portions of the guiding and anchoring tool of FIGS. 1A and 1B and illustrating deployment of the anchoring mechanism and setting or expansion of multiple guide fingers to form a funnel shaped guide receptacle structure that serves to guide well servicing tools into a tool receptacle.

The tubular orifice and seat mounting member 34 defines a generally cylindrical seat pocket 46 within which is secured a generally cylindrical seat member 48, having an upper end that is sealed with respect to the upper portion of the tubular orifice and seat mounting member 34 by an O-ring seal 50. The generally cylindrical seat member 48 defines a cylindrical sidewall in the form of a cage that allows fluid flow in the manner shown by the flow arrow 45 of FIG. 1A. Also, the cylindrical side wall is spaced from the internally enlarged seat pocket wall surface 52, thus defining a flow annulus permitting evenly distributed flow of fluid toward the ports of the diverter plugs 44. The upper extremity of the generally cylindrical seat member 48 defines a tapered or conical seat surface 54 leading to an inlet port 56. A ball closure member 55 (FIG. 2A) is selectively positionable in engagement with the generally cylindrical seat member 48 to prevent the flow of fluid through the inlet port 56, thus permitting pressure-induced development of a downward force that is applied through the generally cylindrical seat member 48 to an annular shoulder 58 of the tubular orifice and seat mounting member 34, and thence to the shear pin or pins 38 that retain the tubular orifice and seat mounting member 34 against movement within the tubular housing 14. When sufficient pressure-induced force is applied to the tubular orifice and seat mounting member 34, the shear pin or pins 38 will be sheared, releasing the tubular orifice and seat mounting member 34 for pressure induced movement downwardly until it reaches and is stopped by the annular stop shoulder 60 of the retainer element 26, as shown in FIG. 2A. Shearing of the shear pins 38 is detected by a pressure change when pump pressure is vented to the well casing via the upper flow ports 18 as shown by the flow arrow 45 in FIG. 2A.

A latch mechanism, shown generally at 61, is defined in part by a tubular collet control member 62 which extends through a central passage 63 of the tubular forming mandrel 30. The tubular collet control member 62 is provided with an upper externally threaded end 64 that is threadedly received within an internally threaded receptacle of the tubular orifice and seat mounting member 34 and is sealed with respect to the tubular orifice and seat mounting member 34 by an O-ring seal 66. The tubular collet control member 62 defines a through passage 68 through which fluid from the coiled tubing string is permitted to flow under controlled circumstances which are discussed in detail below. The tubular collet control member 62 is provided with an enlarged lower terminal end or collet latch section 70 which carries an O-ring seal 72 that, in the position shown in FIG. 1A, is disposed in sealing engagement with a cylindrical internal surface 74 of a tubular latch control mandrel 76, which defines a tool passage or fluid passage 73. The enlarged lower terminal end or collet latch section 70, as shown in FIG. 1A, is positioned internally of the enlarged ends of collet fingers to prevent radially inward unlatching movement of the collet fingers until such time as the enlarged lower terminal end or collet latch section 70 has moved clear of the collet fingers as shown in FIG. 2A.

To the latch control mandrel 76 is threadedly connected a guide mandrel 78 having a cylindrical portion 79 and an upper portion having a multiplicity of longitudinal cuts defining a plurality of elongate guide fingers 80. As shown in FIG. 1A, the elongate guide fingers 80 are arranged in a generally cylindrical finger array, with tapered upper ends 82 thereof being retained against spreading movement by the internally tapered retainer surface 84 of the retainer element 26. The elongate guide fingers 80 define internally projecting thickened sections 86 that define angulated reaction surfaces 88 near the juncture of the guide fingers 80 with the cylindrical portion 79 of the guide mandrel 78. Also, near the juncture of the guide fingers 80 with the cylindrical portion 79, the guide fingers 80 are somewhat weakened as shown at 90 by the cross-sectional geometry of the guide fingers. Further, the guide mandrel 78 is preferably composed of a soft metal, such as dead soft steel, which permits spreading of the guide fingers 80 from the generally cylindrical guide finger array of FIG. 1A to the spread guide finger array of FIG. 2A. This spreading or forming activity is intended to be accomplished downhole by means of a tapered external camming or forming surface 92 of a finger spreading section 94 of the tubular forming mandrel 30.

The tubular latch control mandrel 76 is connected with the cylindrical portion 79 of the guide mandrel 78 by a threaded connection 96 and has a generally cylindrical inner surface 98 and an annular internal collet force control rib 100. The collet force control rib 100 defines annular tapered force control shoulders 102 and 104, with shoulder 102 having a gradual slope and shoulder 104 having a more abrupt slope. A generally cylindrical collet member 106 is provided with a cylindrical connector section 108 which has threaded connection at 110 with the finger spreading or forming section 94 of the tubular forming mandrel 30. The collet member 106 defines a plurality of elongate collet fingers 112, each having an enlarged terminal end 114 defining a gradually tapered shoulder surface 116 and a more abruptly tapered shoulder surface 118. In the latched position of the collet 106, as shown in FIG. 1A, the enlarged terminal ends of the collet fingers 112 are positioned below the annular internal collet force control rib 100, with the more abrupt tapered shoulders 104 and 118 facing one another or in engagement. The inner generally cylindrical internal surface 98 is disposed in spaced relation with the collet fingers 112, thereby permitting the collet fingers to move radially outwardly responsive to application of pushing or pulling force of the collet member 106 against the collet force control rib 100. The gradually sloped tapered surfaces of the enlarged ends of the collet fingers 112 and the annular internal collet force control rib 100 permit radial yielding of the collet fingers at a relatively low range of collet pushing force, for example about 500 pounds, for collet latching, while the more abrupt tapered shoulders of the collet fingers and the annular internal collet force control rib 100 require a substantially greater collet pulling force, for example about 2500 pounds, to cause radially outward unlatching or releasing movement of the collet fingers as shown in FIG. 2A. This significantly greater pulling force requirement for collet releasing permits pull testing of the anchor mechanism to ensure positive anchoring of the anchoring tool or apparatus 10 within the well casing, as will be discussed in greater detail below.

Referring to FIG. 1B, the tubular latch control mandrel 76 is provided with a lower externally threaded extremity 120 to which a tubular anchor housing 122 is threadedly connected and sealed by an O-ring seal 124. The O-ring seal 124 is located within a lower annular enlargement 121 that also defines an opening 123. A tubular support member 126 has an upper connection end 128 having an upper externally threaded portion 130 threaded within an internally threaded portion of the tubular anchor housing 122 establishing a threaded connection 132. Either the internal thread or the external thread or both of threaded connection 132 are designed to define a flow path, shown by a flow arrow, permitting fluid to pass through the threaded connection 132 to accomplish piston-actuated deployment of an anchor mechanism. This fluid flow design is enhanced by stand-off elements 134 that are located between opposed ends of the latch control mandrel 76 and the tubular support member 126. The stand-off elements 134 may be machined into the end of one of the latch control mandrel 76 and the tubular support member 126 or they may take the form of a separate member interposed between the ends of the latch control mandrel 76 and the tubular support member 126. Externally, the upper connection end 128 of the tubular support member 126 may be fluted or otherwise designed to establish a portion of a fluid flow path. The upper connection end 128 of the tubular support member 126 defines an internal retainer pocket 136 within which is received a burst disk element 138 that is sealed within the internal retainer pocket 136 and, until ruptured, defines a barrier that prevents fluid flow through the central flow passage 140 of the tubular support member 126.

The tubular support member 126, below the upper connection end 128, is of significantly less external diameter as compared with the diameter of the internal surface 142 of the tubular anchor housing 122, thus defining an annular piston chamber 144 between the tubular anchor housing 122 and the tubular support member 126. A tubular piston member 146 is movable within the annular piston chamber 144 and is sealed with respect to the inner surface 142 of the tubular anchor housing 122, and with respect to the outer surface of the tubular support member 126 by O-ring type piston seals 148 and 150, respectively. A compression spring package 152, which is preferably composed of a stack of Belleville spring elements or washers, but which may comprise other types of compression springs as well, is located within the annulus between the tubular anchor housing 122 and the tubular support member 126, with the upper end of the compression spring package disposed in force transmitting engagement with an annular shoulder 154 of the tubular piston member 146. The lower end of the spring package 152 is disposed in force transmitting engagement with an annular shoulder 156 of a first anchor actuator member 158. The upper end of the first anchor actuator member 158 is releasably connected with the lower end of the tubular anchor housing 122 by one or more shear pins 160 which are sheared responsive to predetermined force for deployment expansion of a plurality of anchor linkages shown generally at 162 and 164. Each of the anchor linkages comprise a pair of linkage arms 166 and 168, with linkage arms 166 being pivotally connected to the first anchor actuator member 158, and with linkage arms 168 being pivotally connected to a second anchor actuator member 170. The linkage arms 166 and 168 of each anchor linkage are pivotally interconnected with one another so that relative linear movement of the first and second anchor members 158 and 170 causes expansion or contraction movement of the anchor linkages, depending on the direction of movement. The linkage arms 168 define serrations or teeth 169 that establish biting or anchoring engagement with the inner surface of a well casing when the anchoring linkages are forcibly expanded or deployed. It should be noted that some of the anchor linkages are disposed in offset relation with other anchor linkages. This feature ensures that, if some of the anchor linkages are positioned in registry with spaces defined by a casing collar, others of the anchor linkages will be in anchoring engagement with the inner surface of the well casing. The second anchor actuator member 170 has a lower threaded end 172 that is received in threaded engagement within an internally threaded connector collar 174. The internally threaded connector collar 174 defines a lower nose section having a cylindrical internal bearing surface 176 that defines a circular opening through which extends a cylindrical portion 178 of a screen connector member 180 which also establishes threaded connection at 182 with the lower threaded end 184 of the tubular support member 126. The screen connector member 180 provides for connection of a gravel pack screen that enables filtering of the production fluid flowing through the flow passage 140 and prevents gravel from being produced along with the flowing production fluid. The internally threaded connector collar 174 defines an internal stop shoulder 186 that is disposed for engagement by a circular retainer element 188, such as a snap-ring, which is received in an annular external groove of the cylindrical portion 178 of the screen connector member 180 and functions to limit relative linear movement of the screen connector member 180 relative to the second anchor actuator member 170. The circular retainer element 188 also assists in facilitating assembly of the connector collar 174 to the tubular support member 126.

It is desirable to provide for adjustment of the force that accomplishes setting and pull testing of the anchor mechanism. To accomplish this feature, a tubular piston guide member 190 is threadedly connected at 192 with the tubular piston member 146 and, together with the upper end of the piston member 146, defines an annular adjustment receptacle 194. A tubular adjustment ratchet member 196 is located within the annular adjustment receptacle 194 and is threadedly received by an externally threaded section 198 of the tubular support member 126. Thus, upon rotation of the ratchet member 196, the ratchet member 196 is movable linearly along the tubular support member 126 and, being in position controlling engagement with the piston member 146, adjusts the position of the piston member 146 relative to the tubular support member 126. Adjustment movement of the piston member 146 relative to the tubular support member 126 also achieves adjustment of the preload force of the spring package 152 and thus the fluid pressure that is required to accomplish shearing of the shear pins 160 for setting of the anchor mechanism.

Anchor Installation

The anchoring tool 10 is run into a well on a coiled tubing string in the condition shown in FIGS. 1A and 1B, with the anchor linkages collapsed as shown, and with the elongate guide fingers 80 of the guide mandrel 78 also in their retracted positions as shown, and with the ends of the elongate guide fingers 80 retained in their retracted positions by the lower end of the retainer element 26. When the tool has reached its desired depth within the well, it is typically desirable to pump fluid down the coiled tubing string and to eject fluid into the annulus between the tool and the well casing for the purpose of washing sand and other debris upwardly to the surface. This is accomplished by pumping fluid through the coiled tubing string at a pressure that will not deploy the anchor mechanism. This pumped fluid will follow the flow path shown by the flow arrow 45, with the fluid flowing through the diverter plug members 44 and exiting the lower flow ports 20 to the annulus. Fluid in communication with the through passage 68 will be prevented from flowing through the tool by the burst disk 138.

When it is appropriate to deploy the anchor linkages 162 and 164, the pressure of the pumped fluid is increased, thus increasing the pressure-induced force acting on the tubular piston member 146 causing the piston member to compress the spring package 152 and apply force to the shear pins 160. When this pressure-induced force is sufficiently great to shear the shear pins 160, the first anchor actuator member 158 is released for movement along the tubular support member 126 to the anchor deployment position shown in FIG. 2B. Under this force, the second anchor actuator member 170 is permitted to move downwardly until it contacts the upwardly facing shoulder 179 of the screen connector member 180. This piston force-induced movement of the first anchor actuator member 158 moves the anchor linkages 162 and 164 to the fully expanded or deployed positions thereof, causing the teeth 169 to establish anchoring engagement with the internal surface of the well casing. If the tool is positioned with the anchor linkages located at a casing collar, the offset relation of the anchor linkages will nevertheless permit anchoring engagement with the well casing to be established.

After the anchor mechanism has been deployed, by flowing through the coiled tubing string and managing the fluid flow pressure as stated above, it will then be desirable to test the anchor mechanism to ensure that positive anchoring within the well casing has been established. This feature is simply accomplished by application of a pulling force on the tubular housing 14 via the coiled tubing string. From the tubular housing 14, the pulling force is transmitted through the tubular forming mandrel 30 and the latch mechanism 61 to the tubular latch control mandrel 76 and thence to the tubular anchor housing 122 and the tubular support member 126. The pulling force is then translated via the screen connector member 180 to the second anchor actuator member 170, tending to further expand the anchor linkages. Thus, the greater the pulling force, the greater the holding resistance of the anchor mechanism.

Figure 3A:
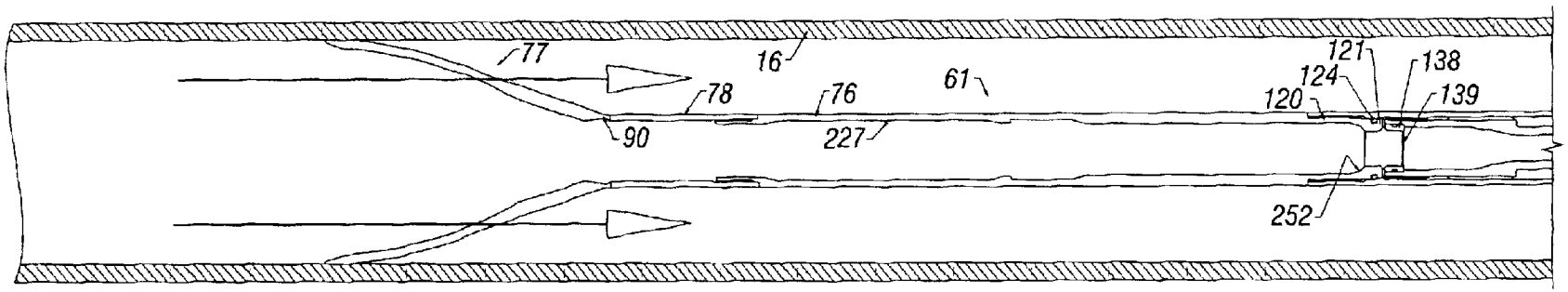
FIGS. 3A and 3B are longitudinal sectional views illustrating the condition of the guiding and anchoring tool during a gravel packing operation, during which fluid laden with gravel is pumped past the guiding and anchoring tool into a desired interval of the well casing to complete the well for production.
Figure 3B:
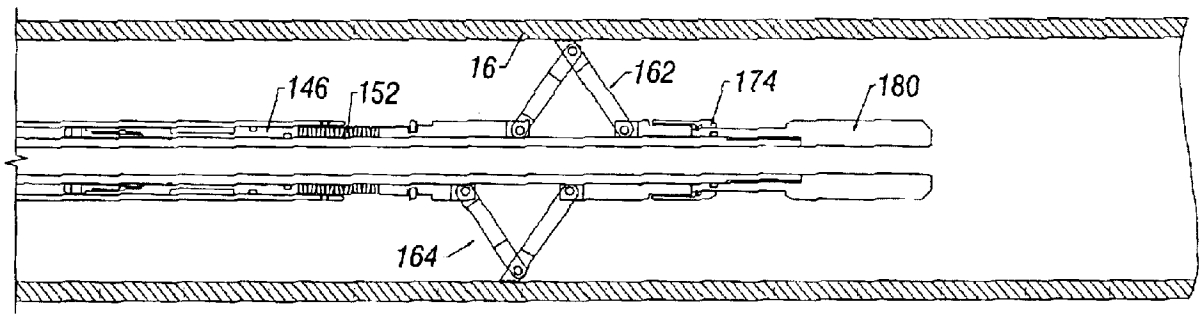

The anchor mechanism will be left anchored within the well, in the condition shown in FIGS. 3A and 3B, thus enabling a gravel packing operation to be conducted to establish a gravel column within the well to prevent production through the gravel and to permit production only through a gravel pack screen and blank or vent pipe into the well where it enters a production tubing string and is then produced to the surface. Subsequent to a gravel packing operation, it is appropriate to run other tools into the anchor mechanism; thus it is desirable to ensure that such tools are simply and efficiently guided into the tubular housing assembly that is centrally located within the well casing and is defined at its upper end by the guide mandrel 78. One suitable means for guiding tools into the guide mandrel 78 is to form in the downhole environment a multi-fingered funnel-shaped guide basket shown generally at 77. As mentioned above, the guide mandrel 78 has a cylindrical portion 79, with a multiplicity of elongate guide fingers 80 integral with the cylindrical portion. The guide mandrel 78, and thus the elongate guide fingers 80, are formed of soft material, such as dead soft steel, so that they can be permanently bent at the weakened sections 90 by a tapered forming surface 92 of a finger spreading section 94 of a forming mandrel 30.

Before the forming mandrel 30 can be moved by a pulling force, it is necessary to release the collet type latch mechanism 61. This is accomplished by applying sufficient force to the tubular orifice and seat mounting member 34 to shear the shear pins 38 and release the tubular orifice and seat mounting member 34 for downward movement until it is stopped by contact with the annular stop shoulder 60. For application of a downward force to the tubular orifice and seat mounting member 34, a ball member 55 is dropped into the coiled tubing and descends or is moved by pumped fluid into sealing contact with the tapered or conical seat 54 and thus functions as a closure for the inlet port 56. With the inlet port 56 closed by the ball member 55, fluid pressure within the coiled tubing, acting on the seal diameter of the O-ring seal 36 is increased to the point that the resulting force causes shearing of the shear pins 38. Downward movement of the tubular orifice and seat mounting member 34 resulting from shearing of the shear pins 38 is detected by a pressure change as pumped fluid upstream of the ball member 55 is vented to the well casing via the upper flow ports 18. Downward movement of the tubular orifice and seat mounting member 34 also causes downward movement of the tubular collet control member 62, thus moving the enlarged collet finger support 70 downwardly to a position clear of the enlarged terminal ends 114 of the plurality of elongate collet fingers 112. With the collet fingers 112 in the latched positions shown in FIG. 1A, and with the enlarged collet finger support 70 moved downwardly after the shear pins 38 have become sheared, the lower ends of the collet fingers 112 will be moved radially inwardly to their release positions by camming interaction of the abruptly and oppositely tapered force control shoulders 104 of the annular internal collet force control rib 100 and 118 of the collet fingers 112. The rather abrupt taper of these opposed shoulder surfaces requires a fairly significant pulling force to accomplish collet release. For example, a pulling force in the range of about 2500 pounds is required according to a desired collet design. The collet release pulling force may be of any desired magnitude, however, simply by changing the angles of the opposed shoulder surfaces 104 and 118.

After collet release has occurred, as shown in FIG. 2A, the tubular housing 14 will be moved upwardly by application of controlled pulling force via the coiled tubing string. This controlled pulling force causes upward movement of the tubular forming mandrel 30 and causes the tapered external camming or forming surface 92 to engage the reaction corners 87 of the elongate guide fingers 80, thus forcing the elongate guide fingers to be essentially pivoted outwardly, thus yielding the weakened sections 90 and causing the elongate guide fingers 80 to be positioned as shown in FIG. 2A, with the tapered upper ends 82 thereof disposed in engagement with the inner surface of the well casing. Thus, any object being moved downwardly within the well casing will be guided by the multi-fingered basket into the central passage of the guide mandrel 78.

Figure 2B:
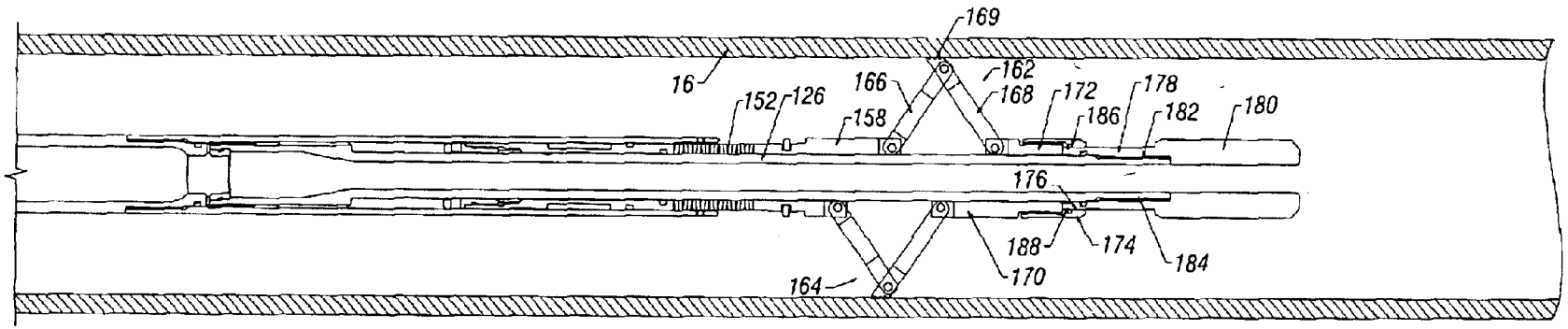

From the condition of the tool as shown in FIGS. 2A and 2B, the coiled tubing string is retracted from the well, along with the tubular forming mandrel 30, the tubular collet control member 62, and the generally cylindrical collet member 106 that are connected to the tubular housing 14, thus leaving the anchoring tool or apparatus 10 at its anchored position downhole. At this point the anchoring tool or apparatus 10 will be of the configuration shown in FIGS. 3A and 3B. As shown by the flow arrows, a gravel packing operation may be conducted, with flow of gravel laden fluid, through the spaces between the elongate guide fingers 80 and through the annulus between the anchoring tool or apparatus 10 and the well casing. Since the burst disk element 138 will not have been ruptured or cut at this point, fluid flow through the anchor tool or apparatus 10 will be prevented.

Figure 4A:
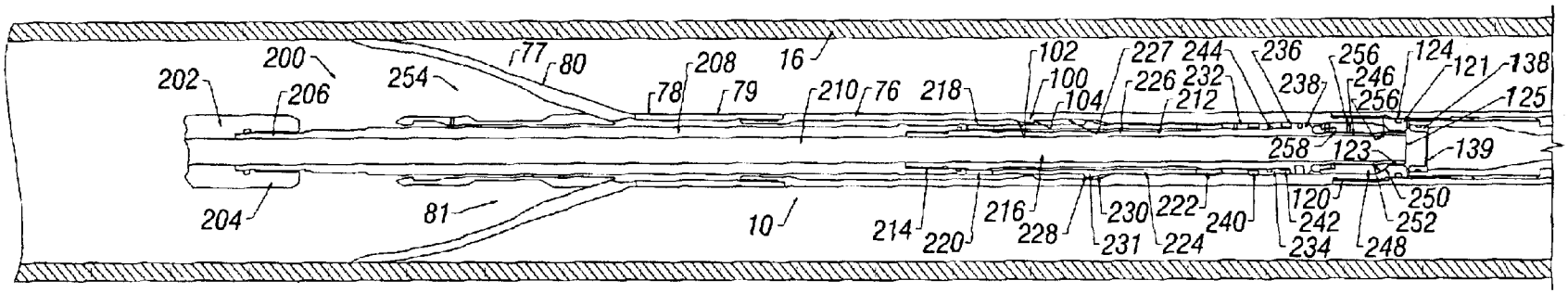
FIGS. 4A and 4B are also longitudinal sectional views illustrating the condition of the guiding and anchoring tool during an optional gravel washing operation.
Figure 4B:
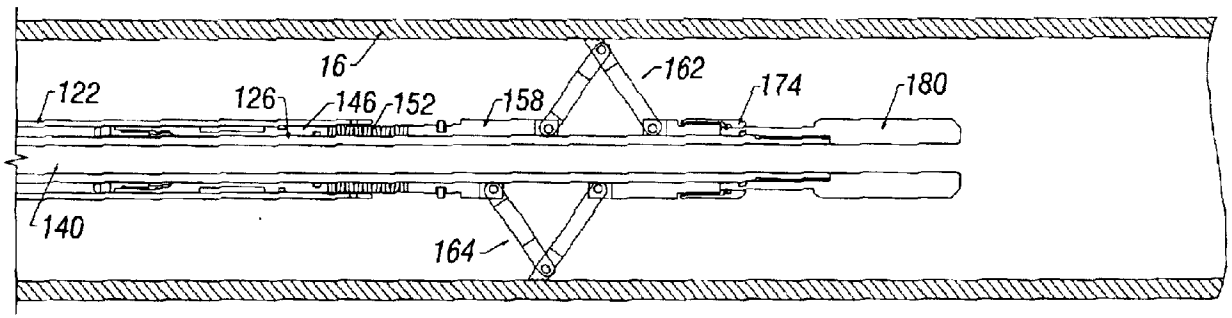

FIGS. 4A and 4B are representative of a gravel washing operation, which is an optional procedure using the anchoring tool or apparatus 10 and also using a gravel washing tool, shown generally at 200, that is run into the anchoring tool or apparatus 10 as shown. The gravel washing tool 200 is mounted to a coiled tubing connector 202 having an internally threaded lower end 204 that receives the externally threaded upper end 206 of a wash tube 208 defining a fluid flow passage 210. A tubular collet positioning element 212 establishes threaded connection with the wash tube 208 at 214 and also defines a flow passage 216 that is in communication with the flow passage 210. A tubular collet member 218 is positioned about the collet positioning element 212 and defines cylindrical ends 220 and 222 with a plurality of flexible collet ribs 224 each being spaced from one another and being integral with the cylindrical ends 220 and 222. Due to the small intermediate diameter surface 226 of the tubular collet positioning element 212 and the enlarged internal surface 227 within the tubular latch control mandrel 76, the collet ribs 224 are permitted to yield radially inwardly responsive to forces that occur as tapered shoulder surfaces 228 and 230 of the collet member 218 react with the tapered shoulder surfaces 102 and 104 of annular collet force control rib 100 of the tubular latch control mandrel 76.

A guide bushing 232 and an annular seal carrier 234 are carried by the tubular collet positioning element 212 below the tubular collet member 218, with the annular seal carrier 234 being in supported engagement with an annular shoulder 236 that is defined by an annular enlargement 238 of the tubular collet positioning element 212. The annular seal carrier 234 is provided with annular seals 240, 242 and 244 for sealing within the tubular latch control mandrel 76 and for sealing with the tubular collet positioning element 212. Below the annular enlargement 238, the tubular collet positioning element 212 defines a tubular extension 246 to which is mounted a bullnose element 248 having a rounded end 250 that is disposed for engagement with a correspondingly curved internal surface 252 within the lower end of the tubular latch control mandrel 76. With the bullnose element 248 fully seated on internal surface 252, the lower end of the tubular extension 246 is located within the opening 123 of the lower sealing end 121 of the tubular latch control mandrel 76 as is evident from FIG. 4A. At the condition of the centralizing and anchoring tool and the gravel washing tool shown in FIG. 4A, an outer bullnose member 254 of the washing tool assembly 200 will have been released from the tubular washing muleshoe by shearing of its shear pin or pins, and will have been moved to a location on the wash tube 208 as the gravel washing tool 200 is run into the tool receptacle that is defined collectively by the tubular guide mandrel 78 and the tubular latch control mandrel 76. Just before the full extent of movement of the gravel washing tool 200 the inner bullnose element 248 will have contacted the internal surface 252, causing shearing of the retainer pins 256 of the inner bullnose element 248 and permitting further downward movement of the tubular extension 246. When this occurs, the retainer ring 258 of the inner bullnose element 248 engages with an external groove on the tubular extension 246, thus securing the inner bullnose element 248 against separation from the tubular extension 246 when the washing tool 200 is retrieved from the well.

With the tubular latch control mandrel 76 and the tubular guide mandrel 78 anchored within the well casing by the sets of anchor linkages 162 and 164, the gravel washing tool 200 is lowered into the well casing by the coiled tubing, with washing fluid being continuously ejected from the wash fluid ejection opening 125 at the lower end of the tubular extension 246. The jetting action of the ejected washing fluid is directed downwardly into the tool receptacle 77 of the guiding and anchoring tool or apparatus 10, causing any sand and other debris that is typically present within the tool receptacle 77 and above the burst disk element 138, to be agitated and entrained within the washing fluid. This jetting action and downward movement, or upward and downward cycling movement of the gravel washing tool 200, returns the fluid entrained gravel, typically sand, upwardly through the annulus between the gravel washing tool 200 and the interior surfaces of the tubular latch control mandrel 76. Confirmation that the gravel within the latch control mandrel 76 has been completely displaced is achieved by movement of the collet enlargements 231 of the collet ribs 224 downwardly past the annular internal force control rib 100. The relatively shallow angles of the tapered surfaces 102 and 230 permit the collet to be moved downwardly, past the annular internal collet force control rib 100 by application of minimal downward force, for example 500 pounds or so. The more abrupt angles 104 and 228 of the collet enlargements and the force control rib cause the release force necessary to yield the collet ribs 224 to be significantly greater when a pulling force is applied via the coiled tubing, thus providing an indication of the position of the wash tube assembly relative to the anchoring tool and also providing an indication that all of the sand and other debris has been removed from the tubular latch control mandrel 76 by the jetting action of fluid flow from the wash fluid ejection opening 125. Again, it should be borne in mind that the gravel washing operation is an optional procedure and may be eliminated assuming that the burst disk penetrating washing tool of FIGS. 5A and 5B is controllably utilized to accomplish gravel washing in the manner described above, prior to accomplishing penetration or rupturing of the burst disk 138.

Figure 5A:
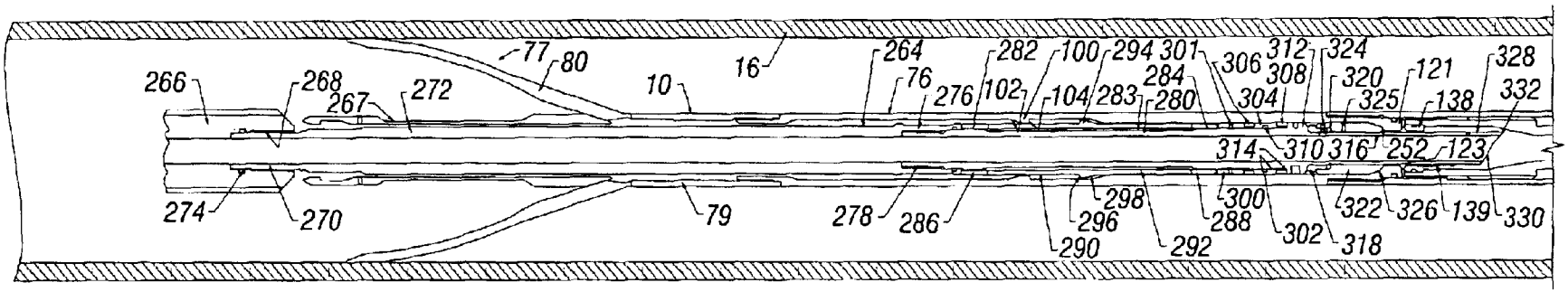
FIGS. 5A and 5B are longitudinal sectional views illustrating an operation where the burst disk of the guiding and anchoring tool is punctured and a straddle tool is latched within the guiding and anchoring tool and verified, and an inflate packer is energized via pumped fluid for sealing of the desired interval of the well.
Figure 5B:
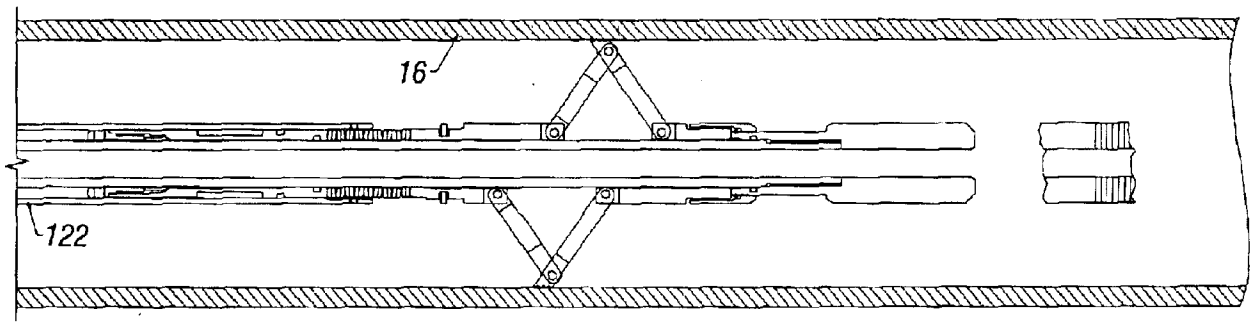
Figure 6A:
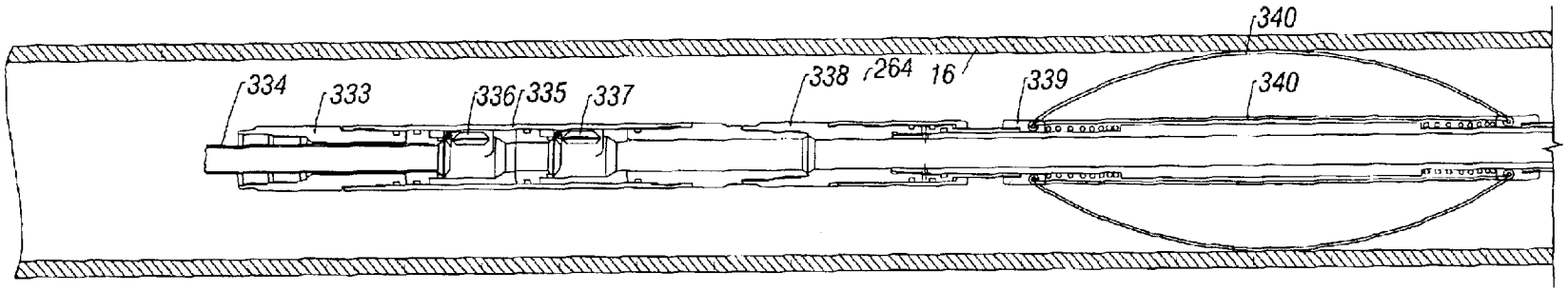
FIG. 6A is a longitudinal sectional view of the upper extremity of a well servicing and completion tool embodying the principles of the present invention.
Figure 6B:
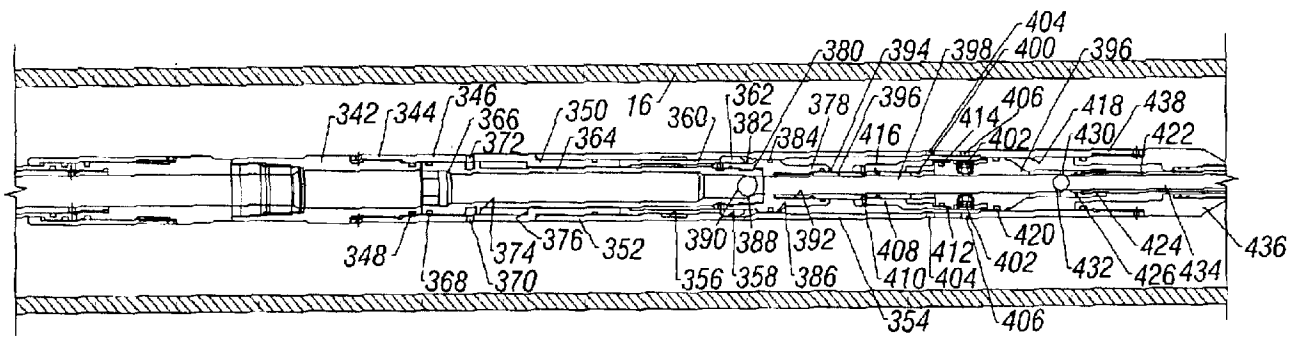
FIG. 6B is a longitudinal sectional view illustrating a latching and flow controlling mechanism embodying an upper intermediate portion of the well servicing and completion tool of the present invention.
Figure 6C:
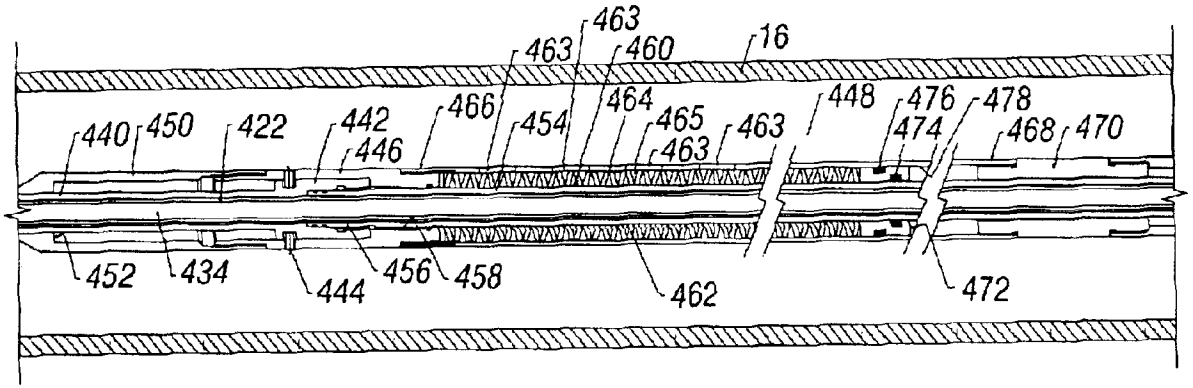
FIG. 6C is a longitudinal sectional view showing a force/pressure compensator mechanism or package that may be included in the well servicing tool string and which has piston loaded springs, such as Belleville springs, responsive to dimensional changes due to temperature and pressure changes, and due to pressure changes resulting from reservoir pressure drawdown or kicking of the well, to protect an inflate packer from damage by exposure to excess differential pressure.
Figure 6D:
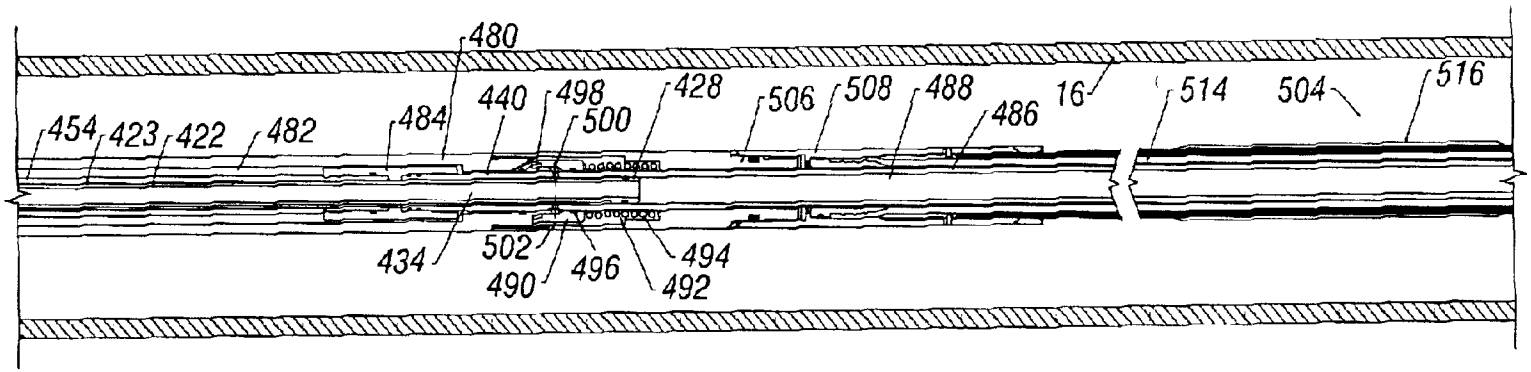
FIG. 6D is a longitudinal sectional view showing another portion of a packer pressure control system and further showing a portion of an inflate packer apparatus for straddle interval sealing.
Figure 6E:
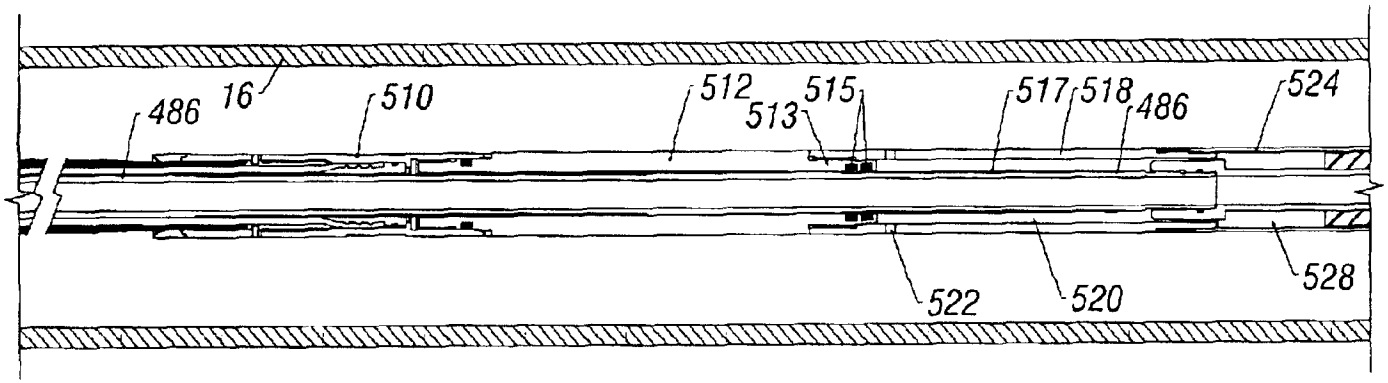
FIG. 6E is a longitudinal sectional view illustrating a lower intermediate portion of the well servicing and completion tool of the present invention.
Figure 6F:
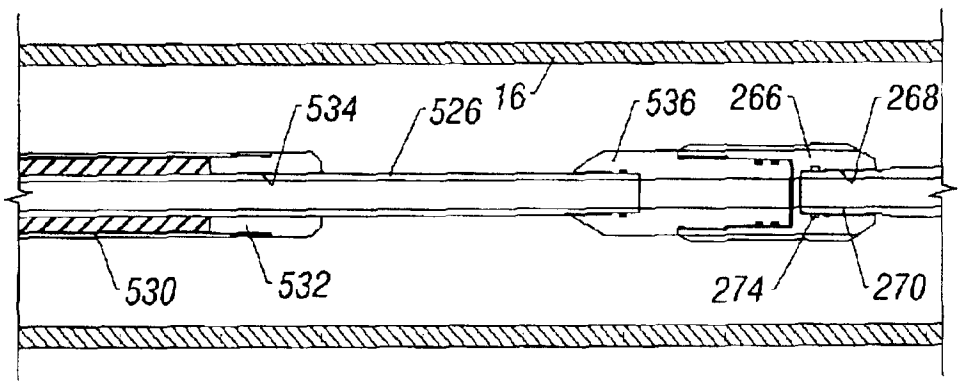
FIG. 6F is a longitudinal sectional view illustrating a flow permitting centralizer section of the well servicing and completion tool.
Figure 6G:
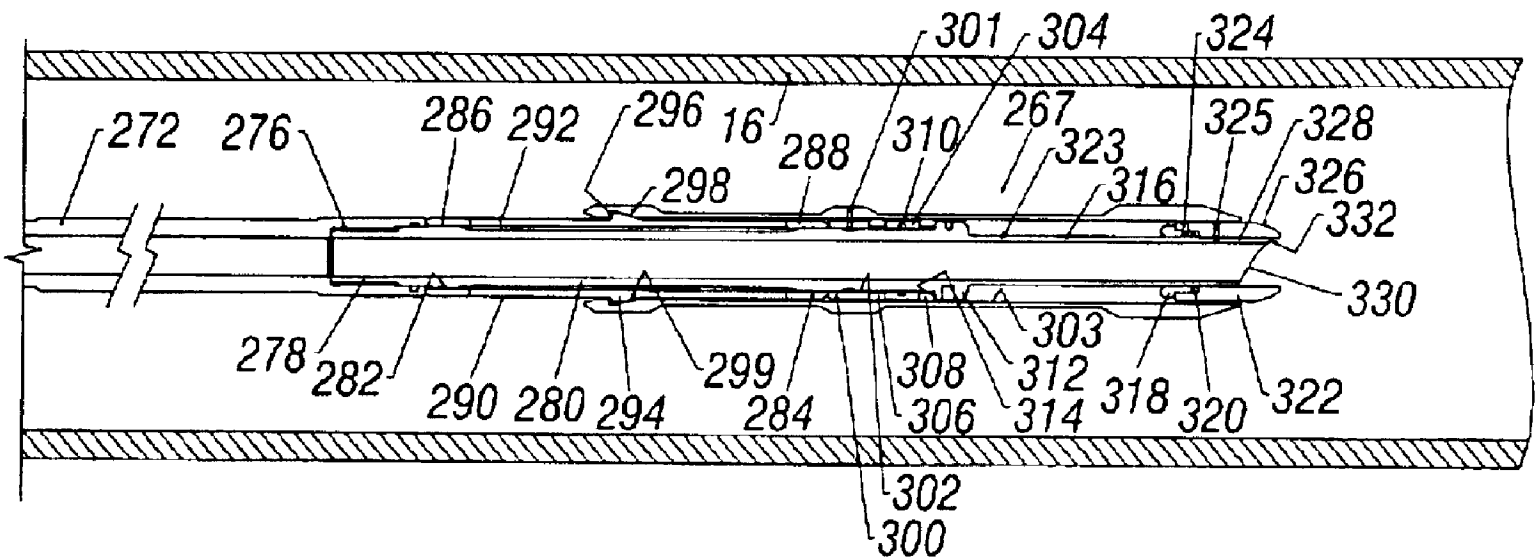
FIG. 6G is a longitudinal sectional view showing the lower extremity of the well servicing and completion tool of FIGS. 6A–6F, and showing a burst disk cutter assembly or cutting bullnose for cutting the burst disk of the anchor tool of FIGS. 3A–5B, and as particularly illustrated in FIG. 5B.

Referring now to FIGS. 5A and 5B and also to FIG. 6G, the lower portion of the well completion tool string, shown in FIGS. 6A–6G generally at 264, is shown to be present within the centralizing and anchoring tool or apparatus 10 and is shown in a position establishing fluid flow communication through the burst panel 139 with the interior of a vent pipe and gravel pack screen assembly about which the gravel pack column is arranged. A fluted centralizer element 266, a component of the well completion tool string, is shown to define an internally threaded receptacle 268 into which the externally threaded upper end 270 of a connecting tube 272 is threadedly received. An O-ring seal 274, or any other suitable type of annular sealing member, is employed to maintain a fluid tight seat of the connecting tube 272 with the fluted centralizer element 266. The lower end of the connecting tube 272 defines an internally threaded receptacle 276 within which is threaded the upper externally threaded end 278 of a tubular collet positioning element 280 having spaced annular collet support surfaces 282 and 284 that support respective cylindrical ends 286 and 288 of a sleeve type collet member shown generally at 290. The sleeve type collet member 290 has a plurality of elongate collet ribs 292 that are integral with the collet ends 286 and 288 and define collet enlargements 294, each having an abruptly tapered surface 296 and a gradually tapered surface 298. The collet enlargements 294 are adapted to be received with a collet receptacle 299 that is defined within the upper end section of the outer bullnose member 267 to retain the outer bullnose member 267 in releasable connection with respect to the tubular collet positioning element 280, for release as the completion tool is run into the tubular latch control mandrel 76 of the anchoring tool 10.

In the same manner as described above in connection with FIG. 4A, to ensure that the elongate guide fingers 80 remain properly positioned within the well casing during movement of the well completion tool string 264 into the tubular latch control mandrel 76 to accomplish an interval cleaning operation, a tubular outer bullnose member 267 will have been released from its protecting position at the lower cutting muleshoe of the well cleaning and completion tool string and will have been moved to the position shown along the connecting tube 272 just above the multi-fingered funnel shaped guide basket 77.

Between the spaced annular collet support surfaces 282 and 284 of the sleeve type collet member 290, the tubular collet positioning element 280 defines a reduced diameter section 283 that permits inward flexing of the spring-like collet ribs 292 of the collet member 290. Each of the spring-like collet ribs 292 define collet enlargements 294 having an abrupt tapered surface 296 and a more gradually tapered surface 298. As the sleeve type collet member 290 is moved downwardly within the tubular latch control mandrel 76 of the anchoring tool 10, the more gradually tapered surfaces 298 of the collet enlargements 294 will come into contact with the gradually tapered surface 102 of the annular internal collet force control rib 100. Further downward movement of the sleeve type collet member 290 past the annular internal collet force control rib 100 requires sufficient downward force to yield the elongate spring-like collet ribs 292 inwardly, so that the collet enlargements 294 can move past the annular internal collet force control rib 100 of the tubular latch control mandrel 76. For example, a required downward collet rib yielding force may be in the order of 500 pounds. A downward force of this small magnitude is well within the capability of coiled tubing conveyance systems, without risking buckling of the coiled tubing string. The more abrupt angled tapered surfaces 296 of the collet enlargements 294 require a significantly greater pulling force on the coiled tubing string to permit release of the collet from within the tubular latch control mandrel 76. For example, a pulling force in the range of about 2500 pounds may be required to extract the collet member 290 from within the tubular latch control mandrel 76. The pushing force of about 500 pounds and pulling force of about 2500 pounds can be measured at the surface, thereby providing well servicing personnel with confirmation that the desired activities have taken place.

The annular collet support surface 284 that provides support and orientation of the lower cylindrical end 288 of the sleeve type collet member 290 is of sufficient length to also provide for support and orientation of an annular sleeve type bearing member 300 that is secured within the outer bullnose member 267 by a retainer pin or pins 301. The bearing member 300 establishes bearing contact with an outer cylindrical surface 302 of the tubular collet positioning element 280. A tubular seal carrier element 304 is also located about the outer cylindrical surface 302 and is provided with outwardly directed end seals 306 and 308 which establish sealing engagement with the cylindrical internal surface 303 of the outer bullnose member 267 and an inwardly directed intermediate seal 310 that establishes sealing engagement with the tubular collet positioning element 280.

The tubular collet positioning element 280 also defines an annular enlargement 312 that defines a support shoulder 314 against which the tubular seal carrier element 304 is seated. Further the tubular collet positioning element 280 defines an integral elongate tubular member 316 which extends below the annular enlargement 312. An annular retainer element 318 is positioned on the elongate tubular member 316 and is secured by a retainer ring 320, such as a snap ring. An inner bullnose member 322 is secured to the annular retainer element 318 by one or more retainer pins 324 and defines a rounded nose surface 326 which is of mating configuration with and adapted to seat on the curved internal surface 252 of the lower sealing end 121 of the tubular latch control mandrel 76, as shown in FIG. 5B. The inner bullnose member 322, which, together with the outer bullnose member 267 and the annular beveled cutting end 330, described below, are referred to herein as a cutting muleshoe. The inner bullnose member 322 is releasably secured to the elongate tubular member 316 by one or more shear pins 325. The retainer ring 320, prior to shearing of the shear pin 325, is interposed between the annular retainer element 318 and the inner bullnose member 322, as shown in FIG. 6F, and engages the outer cylindrical surface of the elongate tubular member 316. When the shear pins 325 become sheared, the retainer ring 320 will be moved along with the annular retainer element 318 and the inner bullnose member 322, until the annular retainer element 318 encounters an external circumferential groove 323 of the elongate tubular member 316. The annular retainer ring 320 will then enter the groove 323 and retain the annular retainer element 318 and the inner bullnose member 322 in assembly with the elongate tubular member 316, thus preventing its inadvertent separation and ensuring that it is retrieved from the well along with the completion tool string.

As is evident from FIGS. 5B and 6F, the integral elongate tubular member 316 is of a dimension enabling its passage through the opening 123 of the lower sealing end and defines an annular beveled cutting end 330 having a sharp penetrating point 332. During downward movement of the well completion tool string 264 within the tubular latch control mandrel 76, after the inner bullnose member 322 has become seated on the curved internal surface 252 and has sheared the shear pins 325, the elongate tubular member 316 will be moved further downwardly, through the opening 123 and will cause the annular beveled cutting end 330 to engage and cut through the frangible burst panel 139 of the burst disk element 138 as shown in FIG. 5B. The annular beveled cutting end 330 is designed to leave a small section of the burst panel 139 uncut, so that downward movement of the lower end portion 328 of tubular member 316 to its full extent will bend the uncut section. This feature permits the cut and bent burst panel 139 to be folded to an out-of-the-way position as shown and causes the burst panel 139 to remain connected to the burst disk element 138, so that it does not fall free from the burst disk element 138 and potentially block the central flow passage 210 of the anchor tool.

Operation

With the anchoring tool 10 properly positioned and anchored within the well casing, the well completion tool string 264 is run into the well casing on a tubing string, preferably a coiled tubing string, as the lower component of a gravel cleaning and well completion tool string as shown in FIGS. 6A–6G, which are discussed in detail below. Typically, fluid is being continuously pumped through the tubing and flows into the annulus, to provide the tubing string with fluid enhanced structural integrity, to enable its pushing force capability to be maximized. After the well completion tool string 264 has emerged from the lower end of the production tubing of the well and has entered the well casing, washing fluid will be continuously pumped through the flow passage of the well completion tool string 264 so that a jet of pumped cleaning fluid is being emitted from the lower tubular end portion 328 of the integral elongate tubular member 316. When the jet of cleaning fluid encounters the gravel column that was established by a gravel packing procedure, the uppermost gravel will be entrained within the fluid by the turbulence of jetting and will be carried upwardly to the surface. Before the centralizing and anchoring tool 10 is encountered, any sand or gravel that is present above the centralizing and anchoring tool will be encountered by the jet of cleaning fluid being emitted. The sand or gravel becomes entrained within the downwardly directed jet of cleaning fluid and is displaced upwardly within the annulus between the well completion tool string and the well casing. When the centralizing and anchoring tool 10 is encountered by the lower end of the well completion tool string 264 the multi-fingered funnel shaped guide basket 77 will centralize the lower end of the tool 10 and guide it into the passage that is defined by the cylindrical portion 79, so that it passes through the tubular latch control mandrel 76 and the tubular anchor housing 122.

Assuming that a quantity of sand or gravel is present within the central passage of the anchoring tool 10, above the burst disk element 138, the jet of pumped cleaning fluid will entrain the sand or gravel and will remove it from the tubular passage. The pumped cleaning fluid and its entrained sand or gravel will flow upwardly through the annulus between the lower portion of the interval cleaning tool and the inner surface of the tubular portion of the anchoring tool 10. The curved internal surface 252 simplifies removal of sand and gravel immediately above the burst disk element 138.

Before latching of the well completion tool string 264 within the tubular latch control mandrel 76, the sharp penetrating point 332 of the annular beveled cutting end 330 of the lower end portion 328 of the tubular member 316 will come into contact with the frangible burst panel 139 of the burst disk element 138. Its continued downward movement will achieve cutting and folding of the burst panel 139 to the position shown in FIG. 5B. When the burst panel 139 has been cut in this manner, communication of the flow passage 210 is established through the gravel column and gravel pack screen with the production interval below the anchoring tool 10 and below the upper packer element. The jet of pumped cleaning fluid being emitted from the flow passage opening of the lower tubular end portion 328 will be directed into the well casing and will entrain and displace excess sand and gravel that is typically present therein. As the guiding and anchoring tool is encountered, the jet of fluid flowing from the flow passage will be directed into the tool receptacle, above the burst disk element 138 and will entrain and remove any gravel that is present, leaving the tool receptacle prepared to receive and latch any suitable well servicing tool.

When the collet enlargements 294 of the collet ribs 224 encounter the annular internal collet force control rib 100 the gradually tapered surfaces 298 of the collet enlargements 294 will engage the gradually tapered surface 102. Downward movement of the well completion tool string will be stopped at this point until a downward force of about 500 pounds is applied to the tool. When this occurs, the elongate collet ribs 292 are forced to yield inwardly, permitting the sleeve type collet member 290 to move past the annular internal collet force control rib 100. Relief of the downward force is detected at the surface, indicating that the collet member 290 has moved into latching condition within the latch control mandrel 76. This latching condition may be verified by application of a pulling force to the well completion tool string. When a pulling force is applied to the collet member 290 via the coiled tubing string and tool assembly, the more abrupt tapered surfaces 296 of the collet enlargements 294 will be forced against the abrupt tapered surface 104 of the annular internal collet force control rib 100, tending to yield the collet ribs inwardly. Due to the abrupt angled surfaces, a pulling force in the range of about 2500 pounds will be required to separate the collet connection. Thus, a significant pulling force may be applied for purposes of verification of collet latching, without causing collet separation or release. After collet latching verification has been accomplished, the inflate packer of the well completion tool string may be inflated, as explained below, and production interval cleaning may be carried out by jetting cleaning fluid into the well casing to entrain sand and gravel and transport it to the surface or conduct it into a portion of the wellbore below the production interval of the well.

FIGS. 6A–6G are longitudinal sectional views each showing different sections of the completion tool string, shown generally at 264, for conducing well servicing activities, such as cleaning excess gravel from the production intervals of wells and completing the wells for production. It should be borne in mind that only the lower portion of the completion tool string 264 of FIGS. 6F and 6G is shown in FIGS. 5A and 5B. Referring first to FIG. 6A, a completion tool assembly, also referred to as a completion tool string or well servicing tool string, is shown generally at 264 and at its upper end has a tubing connector 333 for connection of the completion tool string with tubing 334, preferably coiled tubing, by which the completion tool string is run into and retrieved from a well. When the completion tool string incorporates check valves, as shown in FIG. 6A, a tubular valve body 335 is provided, within which are mounted check valves 336 and 337. Below the valve body 335 is provided a connector 338 which provides support for a centralizing spring assembly 339 having centralizing bow springs 340 for centralizing the upper end of the well servicing tool string within the well casing. The bow springs 340 are capable of being collapsed to enable the servicing tool string to be run through the tubing string of a well and into the well casing below the tubing string, where the bow springs expand to establish centralizing contact with the well casing. A connector 342 extends from the lower end of the centralizing spring assembly 339 to enable the threaded connection of the upper end section 344 of a latch connector 346. An annular sealing element, such as an O-ring seal 348, maintains a sealed relation of the latch connector 346 with respect to the coiled tubing connector 342. The latch connector 346 defines a reduced diameter section 350 which receives the upper end 352 of a tubular latch body 354 defining internal upper and lower latch profiles 356 and 358. A plurality of elongate flexible collet fingers 360 are integral with the tubular latch connector 346 and are each provided with latching enlargements 362 that are adapted for engagement within the upper or lower latch profiles, depending on the position of the latch connector 346 with respect to the latch body 354.

A fluid flow control sleeve 364 is linearly movable within the latch body 354 and has an upper end portion 366 that is sealed within the latch connector 346 by an O-ring sealing member 368 and, when the fluid flow control sleeve 364 is positioned as shown in FIG. 6B, serves as a closure for one or more ports 370. The fluid flow control sleeve 364 is releasably secured in immovable assembly with the latch connector 346 by one or more shear pins 372, which become sheared when predetermined downward force is applied to the fluid flow control sleeve 364 as described below. After having been released from the latch connector 346 by shearing of the shear pins 372, downward movement of the fluid flow control sleeve 364 will occur to the extent permitted by the annular space between annular stop shoulders 374 of the fluid flow control sleeve 364 and 376 of the latch connector 346.

A tubular connector element 378 is mounted to the lower end of the fluid flow control sleeve 364 by a threaded connection 380 and has an outer cylindrical surface 382 that is of greater diameter as compared with the outer diameter of the fluid flow control sleeve 364. When the fluid flow control sleeve 364 is positioned as shown in FIG. 6B, the outer cylindrical surface 382 is positioned to restrain the latching enlargements 362 of the elongate flexible collet fingers 360 from being moved radially inwardly as a pulling force is applied to the latch connector 346. The tubular connector element 378 is provided with an annular sealing element 384, such as an O-ring seal, for maintaining sealing of the tubular connector element 378 with respect to the inner cylindrical sealing surface 386 of the tubular latch body 354. The fluid flow control sleeve 364 defines an internal ball seat 388 having a tapered or frusto-conical seat surface against which a ball member 390 is adapted to seat when downward movement of the fluid flow control sleeve 364 is intended.

The tubular connector element 378 is provided with an internally threaded receptacle 392 within which is received the upper externally threaded end of a tubular upper end portion 394 of a fluid flow control mandrel 396. The fluid flow control mandrel 396 defines a central flow passage 398 and upper and lower flow ports 400 and 402 that are positioned as shown in FIG. 6B in registry with upper and lower ports 404 and 406. The flow ports 402 are of large diameter and are lined with a replaceable erosion resistant insert to minimize the potential for excessive wear or erosion of the flow ports by sand, gravel or other debris that may be entrained in the flowing fluid. An isolation sleeve member 408 is secured to the tubular upper end portion 394 of fluid flow control mandrel 396 by one or more shear pins 410 and defines a lower tubular section 412 that is sealed to the fluid flow control mandrel 396 and overlies the upper flow ports 400 and thus restricts fluid flow to the lower, sleeve lined flow ports 402. When it is desired to permit fluid to flow through the upper flow ports 400, flow passage pressure is increased to the point that the upwardly directed differential pressure responsive force acting on the isolation sleeve member 408, that results from the larger diameter of O-ring seal 414 as compared with the smaller diameter of O-ring seal 416, becomes sufficient to cause shearing of the shear pins 410. When the pins are sheared, the upwardly directed differential pressure responsive force will move the isolation sleeve member 408 upwardly until its upward movement is stopped by the lower end of the tubular connector element 378, thus exposing the upper flow ports 400.

The fluid flow control mandrel 396, when in the position shown in FIG. 6B, is sealed to the inner cylindrical surface 418 by an O-ring seal 420 and defines an internal ball seat 430 that is located for engagement by a drop ball 432. An elongate, generally cylindrical stinger tube 422 is secured within the lower internally threaded extremity of the fluid flow control mandrel 396 by a threaded connection 424 and is sealed to the fluid flow control mandrel 396 by an O-ring seal 426. Except for the lower sealing end 428 (FIG. 6D) of the stinger tube 422, the stinger tube is disposed in spaced relation within other tubular members and defines an annular space 423 that represents a pressure communicating annulus for communicating inflation pressure to the relief valve 490 (FIG. 6D) as described below. A supporting connector 436 may be threadedly connected within a lower connection extension 438 of the tubular latch body 354. To the supporting connector 436 is threadedly connected the upper end of a tubular connecting stem 440 of a releasable pressure compensator connector 442. Shear pins 444 releasably retain the releasable pressure compensator connector 442 in assembly within a tubular end fitting 446 of a pressure compensator shown generally at 448. A restraint cap 450 is threaded to the tubular upper end member 446 and defines an inner restraint shoulder 452 that serves to stop upward movement of the releasable pressure compensator connector 442 after the shear pins 444 have been sheared by application of a pulling force to the tubular connecting stem 440.

A tubular force transmitting member 454 has an upper connecting end 456 extending through a central passage 458 of the tubular end fitting 446 and being threadedly received within the releasable pressure compensator connector 442. The outer cylindrical surface 460 serves as a housing surface for a spring package 462, which is preferably composed of a plurality of oppositely arranged Belleville springs, forming a spring stack, but which may comprise a compression spring of any other character. A tubular spring housing 464 has its upper and lower ends 466 and 468 disposed in threaded connection, respectively, with the tubular end fitting 446 and a tubular connector member 470. The tubular spring housing 464 defines fluid interchange openings 463 and cooperates with the outer cylindrical surface 460 to define an elongate, annular spring chamber 465 within which the spring package or stack 462 is contained. An annular floating piston member 472 is disposed in force transmitting engagement with the lower imperforate end of the spring package 462 and carries inner and outer O-ring seals 474 and 476 having sealing engagement, respectively, with the outer cylindrical sealing surface 460 and the inner cylindrical surface 478 that is defined within the lower imperforate end of the tubular spring housing 464.

To the tubular connector member 470 is fixed a stem movement control housing 480, defining an elongate internal chamber 482 within which is linearly movable a portion of the tubular force transmitting member 454 and a coupling element 484 to which is also threadedly connected the upper end of an elongate connecting tube 486 that defines a flow passage 488 therethrough which forms a part of the flow passage through the tool.

It is desirable, according to the features of the present invention, to provide means for controlling the operating pressure of an inflate packer portion of the tool string and for compensating for any pressure loss of the inflate packer. According to the present invention, one suitable packer operating pressure control system includes a relief valve 490 that is movable within a valve chamber 492 and is energized toward its closed position by a compression spring 494. The relief valve 490 is sealed to the outer cylindrical surface of the elongate connecting tube 486 by an O-ring seal 496 and is sealed to an annular tubular projection of the stem movement control housing 480 by an annular sealing element 498. When a drop ball 432 is seated within the ball seat of the stinger tube 422, fluid pressure from within the flow passage 434 of the stinger tube 422 enters the valve chamber 492 between the seals 496 and 498 via ports 500 in the elongate connecting tube 486 and acts on the different diameters of the seals 496 and 498, thus creating a pressure responsive resultant force acting to move the relief valve 490 downwardly against the force of its compression spring 494. When the force developed by the pressure acting on the different diameters of the seals 496 and 498 becomes sufficiently great to overcome the preload force of the compression spring 494, the relief valve 490 will be moved downwardly, and, at a particular point of its downward movement, will permit the pressure to enter the full chamber 492 and act on the lower annular end surface of the annular floating piston member 472 and thus applying a pressure responsive piston force to the spring package 462. When the opening pressure of the relief valve 490 is reached, the relief pressure is communicated within the tool and causes inflation and sealing of an inflate packer assembly, shown generally at 504, and also is conducted into the valve chamber 492 to provide a source of pressure that continuously acts within the inflate packer 504 to compensate for any leakage of the inflate packer 504 or to compensate for any pressure or temperature induced changes in the dimension of the casing or other components that influence the sealing capability of the inflate packer 504.

At the upper end of the inflate packer assembly 504, a packer coupling 506 is threadedly connected and sealed with the stem movement control housing 480. The inflate packer assembly 504 has upper and lower packer connecting ends 508 and 510 for connection of the packer assembly 504 with the upper packer coupling 506 and with a restraint connector 512. A lower threaded extension 513 of the restraint connector 512 is provided with internal seals 515 which maintain sealing engagement with an external sealing surface 517 of the elongate connecting tube 486. After the relief pressure of the relief valve 490 has been reached, the pressure being applied to the annular floating piston member 472 is also applied within the expansion bladder 514 of the inflate packer assembly 504, thus expanding the expansion bladder 514 and its packer sleeve 516 into sealing relation with the inner surface of the well casing. Also, after the relief pressure of the relief valve 490 has been reached, the pressure being applied to the inflate packer 504 will have become substantially stabilized at a packer differential pressure, thus preventing excessive inflation pressure from potentially damaging the inflate packer 504. The relief valve 490 also serves as a closure to maintain inflation and sealing of the inflate packer 504.

After the inflate packer 504 has been deployed and the burst disk has been cut, the well completion procedure will have been finalized. To enable production from the well, the coiled tubing string is retrieved by application of sufficient pulling force to release the elongate flexible collet fingers 360 from the latch profiles 356 and 358 and to retrieve the fluid flow control mandrel 396 and the elongate generally cylindrical stinger tube 422, thus leaving the flow passage 488 open for production flow from the well.

To the restraint connector 512 is threaded a tubular restraint member 518, which is disposed in spaced relation with the elongate connecting tube 486 and defines an annular chamber 520. The annular chamber 520 is exposed to casing pressure via one or more ports 522. A crush housing 524 is threaded to the lower end of the tubular restraint member 518 and is disposed in spaced relation with a connector tube 526 and defines an annular space within which is located a stop ring 528 and a resilient crush body 530. A lower cap member 532 closes the lower end of the crush housing 524 and defines a passage 534 through which the connector tube 526 extends.

Below the crush housing 524 a centralizer connector 536 is threaded to the lower end of the connector tube 526 and provides support for the fluted centralizer element 266 as shown in FIG. 6F. The connecting tube 272 is threadedly connected with the lower end of the fluted centralizer element 266 and abuts at its lower end a sleeve type collet member 290 which is designed with a plurality of elongate collet ribs 292 each having collet enlargements 294 with angulated surfaces enabling collet engagement at a desired force range, for example about 500 pounds, and a significantly greater collet release force, for example about 2500 pounds. The sleeve type collet member 290 has a lower connecting end threaded to an externally threaded section of tubular collet positioning element 280.

A lower end connector of the connecting tube 272 defines an internally threaded receptacle 268 into which is threaded the upper end 270 of an elongate tubular burst disk cutter member 316, also referred to as a cutting muleshoe. An annular bearing member 300 and a tubular seal carrier element 304 are located externally of the tubular burst disk cutter member 316 and provide bearing support and sealing with respect to an inner surface 303 of an outer tubular bullnose member 267. The annular bearing member 300 is releasably secured to the outer bullnose member 267 be means of one or more shear pins 301 that become sheared when the outer bullnose member 267 encounters predetermined resistance due to contact with the burst disk structure or any other stop member. The tubular seal carrier element 304 is provided with external seals 306 and 308 that are in sealing engagement with the inner surface of the outer bullnose element 267 and an internal seal 310 that is disposed in sealing engagement with an outer cylindrical surface of the burst disk cutter element 316. The burst disk cutter element 316 includes an elongate cutter tube 328 having a beveled cutting end 330 and a sharp cutter point 332 for penetrating and cutting the burst disk and positioning the cut-out section of the burst disk so that it will not interfere with fluid flow from the production interval below the tool. To ensure against accidental cutting of the burst disk, an inner bullnose member 322 is pinned to the elongate cutter tube 328 and is positioned so that its lower end extends past the sharp cutter point 332. Only when sufficient force is applied to the inner bullnose member 322 to shear the pins 325 will the inner bullnose member 322 be moved to a position exposing the beveled cutting end 330 and sharp cutter point 332 of the elongate cutter tube 328. When the shear pins 325 have been sheared, the inner bullnose member 322 will be moved along the cutter tube, thus exposing the cutting end 330 for cutting of the burst panel 139. To ensure that the inner bullnose member 322 remains in assembly with the elongate cutter tube 328, a retainer ring 320, such as a snap ring, is moved along the elongate cutter tube 328 until it enters an external circumferential groove 323 of the cutter element 316.

To assure re-entry into a guiding and anchoring tool anchored within a well casing during a previous operation, such as a gravel packing operation or any of a number of other well servicing or completion operations, a running tool is employed having a ratcheting centralizer, a burst disk, collet disconnect, swage, guide fingers and a centralizing anchor mechanism. During the running operation, the guide fingers are collapsed and retained so that they cannot be deployed until the desired position of the running tool has been achieved and confirmed. The guide fingers are integrally connected with the running tool via integral plastically deformed hinge sections that will readily yield when expansion force is applied to the guide fingers by an expansion swage, thus avoiding the need for a guide finger locking mechanism. The running tool is run into a well casing to a desired location within the casing, such as above casing perforations that communicate a natural gas production formation with the interior of the well casing. Typically, to enhance the structural integrity of the running tubing, which is preferably coiled tubing, fluid is continuously pumped through the running tubing during its movement into the well. At this point, for removal of gravel that may be present well above the screen and blank pipe, fluid is pumped through the tool and is caused to flow into the casing to entrain gravel and then is returned to the surface via the tool annulus for transporting the excess gravel to the surface. The re-entry and anchoring tool employs a two bar linkage type centralizer and anchor mechanism employing a plurality of circumferentially spaced anchor linkages that are secured in retracted positions by one or more shear pins during running and are simultaneously deployed or expanded to tool centralizing and anchoring positions when the shear pins become sheared. A burst disk that is present within the tool blocks the flow passage within the tool and permits application of pressure induced force to the shear pins that retain the anchoring mechanism in its retracted position.

After the running and anchoring tool has been properly positioned, fluid is pumped through the coiled tubing to develop a pressure responsive force that causes shear pins to shear and release the anchor mechanism for deployment expansion to engage the inner surface of the well casing and become anchored and to also centralize the running and anchoring tool within the well casing. To verify anchoring, a pulling force is applied through the coiled tubing string. When properly anchored, the anchor mechanism will resist a significant pulling force, thus permitting the position and condition of the running and anchoring tool to be verified and maintained.

After anchoring has been verified, a closure ball is run through the coiled tubing to a ball seat to close the flow passage through the tool. Fluid pressure within the coiled tubing string is then increased until the upper shear pins 38 have been sheared, thus permitting pressure responsive movement of the collet support to its downward collet release position. Then, the pulling force is increased until the collet mechanism releases, and permits upward movement of the retainer element 26 and the tubular forming mandrel and its tapered swage surfaces relative to the running and anchoring tool. As the tubular forming mandrel is moved upwardly, its tapered swage geometry forcibly reacts with the geometry of the elongate guide fingers and forces the guide fingers to pivot outwardly about the plastic hinge sections 90 until the ends of the elongate guide fingers contact the inner surface of the casing. Being composed of soft metal, the elongate guide fingers will remain in this swage formed position rather than springing away from the casing when the swaging force is released.

At this point, the coiled tubing string is retrieved from the well casing, along with the tubular forming mandrel and the collet portion of the latching mechanism, thus leaving within the casing, as shown in FIGS. 3A and 3B, the deployed centralizing and anchor mechanism, with the burst disk in place within the tool to prevent gravel from entering the screen below the anchor mechanism during a subsequent fracturing operation. Most importantly, the elongate guide fingers at the upper end of the running and anchoring tool are positioned to guide a subsequently run tool to and into its central passage. With the running and anchoring tool thus deployed, a gravel packing operation is typically carried out, resulting in the annulus between the tool and the casing being packed with gravel and typically causing some gravel to be located above the upper end of the running and anchoring tool and causing the central passage of the tool to be filled with gravel down to the burst disk.

To prepare the well for completion and production, as shown in FIGS. 4A and 4B (an optional gravel washing procedure) a gravel washing tool 200 is run into the well and is guided into the centralized passage 81 by the funnel shaped arrangement of the elongate guide fingers 80 of the guide mandrel 78. The gravel washing tool employs a bullnose at its lower end to prevent rupture of the burst disk and directs a jet of cleaning fluid into the centralized passage 81 to entrain and remove any deposit of gravel that might be present above the burst disk. As confirmation that the gravel washing tool has entered the centralized passage 81, the tool will encounter a collet entry resistance force in the range of about 500 pounds due to interaction of the tapered surfaces 102 and 230. Release of the collet from the collet profile requires a pulling force of greater magnitude, in the range of about 2500 pounds due to interaction of the more abrupt tapered surfaces 104 and 228. This greater pulling force again confirms that the anchor mechanism remains functional, and if the anchor mechanism is not properly anchored within the casing, causes retrieval of the anchor mechanism and the screen.

Preferably, as shown in FIGS. 5A and 5B, a well completion tool string 264 including an inflate packer assembly and packer pressure control is run downhole on a coiled tubing string and is guided into the centralized passage 81 while pumped fluid is flowing from the lower end to entrain and transport deposited gravel from the centralized passage 81 to entrain and remove gravel down to the burst disk 138. After complete gravel removal has been assured, a downward force is applied to the well completion tool string 264, causing the annular beveled cutting end or cutting muleshoe 330 to be released from the inner and outer bullnose elements and cut through the frangible burst panel 139 of the burst disk element 138, thereby exposing the interior of the screen to the flow passage of the blank pipe above the screen.

After having cleaned the gravel from the tool in the manner described above, a pulling force of sufficient magnitude is applied via the coiled tubing string to release the collet fingers 360 from the upper and lower latch profiles and to extract the fluid flow control mandrel 396 and its elongate generally cylindrical stinger tube 422, thus leaving the flow passage 488 open to produce the well. Production will flow through the gravel pack column into the gravel pack screen and will then be conducted upwardly, above the gravel column by the blank or vent pipe into the well casing above the gravel pack column and above the inflate packer. The flowing production will then enter the production tubing and will be conducted to the surface and will flow from a wellhead and into a suitable receptacle, such as a flow line or vessel or combination thereof.

While the present invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the scope of the invention as defined by the appended claims.

We claim:

1. A method for conditioning a well for re-entry of well tools, the well having a well casing and a restriction and/or well tubing therein, the method comprising:

with a running tool, running a guiding tool through the restriction and/or well tubing and into the well casing to a desired location, said guiding tool defining a tool receptacle having a retracted position for running through the restriction and/or well tubing;

with said guiding tool located within the well casing, moving said tool receptacle from said retracted position to establish a guiding configuration within the well casing for subsequent guiding of well tools into said tool receptacle; and recovering said running tool to the surface;

wherein said tool receptacle comprises a plurality of elongated guide fingers, and moving said tool receptacle from said refracted position comprises moving said elongate guide fingers from a retracted position.

2. The method of claim 1, wherein said elongate guide fingers are connected to said guiding tool and have reaction members thereon and a finger spreading member is mounted to said running tool, said method further comprising:

contacting said reaction members with said finger spreading member; and moving said finger spreading member relative to said reaction members and causing each of said elongate fingers to be positioned with end portions thereof in tool guiding relation within the well casing.

3. The method of claim 1, wherein said elongate guide fingers are integral with said guiding tool and have plastic hinge sections to promote localized bending of said elongate guide fingers at said plastic hinge sections, said elongate guide fingers have reaction portions thereon, and a tapered swage member is mounted to said running tool, said method further comprising:

contacting said reaction portions of said elongate guide fingers with said swage member; and moving said swage member relative to said reaction portions causing bending of each of said plastic hinge sections and causing each of said elongate fingers to be moved to outwardly inclined positions with end portions thereof disposed in tool guiding relation within the well casing.

4. The method of claim 1, wherein said guiding tool has an anchoring mechanism having a retracted position for running thereof through the restriction and/or well tubing and an anchoring position establishing anchoring relation within the well casing, said method further comprising:

after achieving desired location of said guiding tool within the well casing, actuating said anchoring mechanism and establishing anchoring of said guiding tool within the well casing.

5. A method for gravel packing and completing a well having a well casing and having production tubing extending through the well casing to a desired location, comprising:

with a running tool, running a centralizing and anchoring tool through the production tubing and into the well casing to a desired location, said centralizing and anchoring tool defining a tubular housing having a central tool passage and having a centralizing and anchoring mechanism movable from a retracted position for through tubing movement to a centralizing and anchoring position in centralizing and anchoring engagement with the well casing, said centralizing and anchoring tool having a tool receptacle having a retracted position for through tubing movement;

moving said centralizing and anchoring mechanism from said retracted position to said centralizing and anchoring position within the well casing; and moving said tool receptacle from said retracted position to establish a guiding configuration.

6. The method of claim 5, wherein said tool receptacle comprises a plurality of elongate guide fingers, said method further comprising forming said plurality of elongate guide fingers to a guiding configuration with said elongate guide fingers in guiding position with the well casing for subsequent guiding of tools into said central tool passage.

7. The method of claim 6, wherein said running tool and said centralizing and anchoring tool have releasable latching connection, said method further comprising:

after said forming of said plurality of elongate guide fingers, releasing said latching connection of said running tool with said centralizing and anchoring tool and recovering said running tool to the surface.

8. The method of claim 5, wherein at least one retainer releasably secures said centralizing and anchoring mechanism at said retracted position and a pressure responsive piston is located to apply a releasing force to said at least one retainer, said step of moving said centralizing and anchoring mechanism from said retracted position to said centralizing and anchoring position, said method further comprising:

creating a fluid flow responsive pressure of sufficient magnitude within said central tool passage which acts on said pressure responsive piston and develops a pressure responsive piston force releasing said at least one retainer and moving said centralizing and anchoring mechanism to said centralizing and anchoring position.

9. The method of claim 8, wherein said centralizing and anchoring mechanism includes a plurality of two bar linkages mounted to said tubular housing and having a movable actuator disposed in force receiving relation with said pressure responsive piston, and said at least one retainer being at least one shear pin, said method further comprising:

applying sufficient pressure responsive piston force to said movable actuator to shear said at least one shear pin and release said movable actuator and move said movable actuator and thus move said plurality of two bar linkages from said retracted position to said centralizing and anchoring position.

10. The method of claim 9, wherein a force transmitting spring is interposed between said movable actuator and said pressure responsive piston, said method further comprising:

when said movable actuator has been released and has moved said plurality of two bar linkages from said retracted position to said centralizing and anchoring position, continuously applying an urging force to said movable actuator and maintaining said two bar linkages in centralizing and anchoring relation with the well casing.

11. The method of claim 6, wherein said tubular housing has a tubular latch control mandrel defining a latch profile therein, and said running tool has a collet member movable into latching relation with said latch profile and separable from said latching profile upon application of predetermined collet releasing force, said method further comprising:

maintaining latching engagement of said collet member with said latch profile during said running of said centralizing and anchoring tool;

after said moving said centralizing and anchoring mechanism from said retracted position to said centralizing and anchoring position, applying a predetermined pull test force to said tubular housing to ensure anchoring of said centralizing and anchoring mechanism within the well casing.

12. The method of claim 11, wherein said plurality of elongate guide fingers have integral hinge sections designed for localized yielding and a forming mandrel is connected with said collet member and defines a tapered swage surface, said method further comprising:

after releasing said collet member from said latch profile, forming said plurality of elongate guide fingers to said guiding configuration by moving said tapered swage surface of said forming mandrel relative to said plurality of elongate guide fingers and causing said tapered swage surface to permanently yield said plurality of elongate guide fingers at said integral hinge sections and position ends of said plurality of elongate guide fingers in guiding relation with said well casing.

13. The method of claim 6, wherein a burst disk is located within said central tool passage having and isolating the interior of a gravel pack screen from gravel during a gravel packing operation, said method further comprising:

conducting a gravel packing operation conducting gravel entrained fluid through spaces between said elongate guide fingers and depositing a gravel column within a desired section of the well casing and an annulus between the well casing and said centralizing and anchoring tool;

running a well completion tool string having a packer and a cutting muleshoe through said production tubing;

flowing cleaning fluid from said cutting muleshoe and removing excess gravel from the casing annulus and from said tubular housing above said burst disk;

cutting through said burst disk with said cutting muleshoe, thus communicating said screen through said tubular housing with the well casing above said packer; and setting said packer of said well completion tool in sealing relation with said well casing immediately above the gravel column.

14. The method of claim 13, wherein said tubular housing defines an internal latching profile and a latching collet is provided on said well completion tool string, said method further comprising:

moving said well completion tool string into said tubular housing until said latching collet moves into latching relation with said internal latching profile, said latching relation being detected by predetermined resistance to said moving; and when desired, releasing said latching collet from said internal latching profile by application of predetermined pulling force on said well completion tool string, enabling retrieval of said well completion tool string and said running tool.

15. The method of claim 14, wherein a fluid flow control mandrel having an internal ball seat is located and sealed within said central tool passage and said packer is an inflate packer and a relief valve permits communication of actuating pressure to said inflate packer, said method further comprising:

positioning a ball closure in sealing engagement with said internal ball seat, thus blocking communication of pressure from said flow control mandrel into said central tool passage below said internal ball seat and thereby exposing said relief valve to increased pressure; and raising said pressure within said flow control mandrel until said relief valve opens and admits packer inflation pressure into said inflate packer.

16. A re-enterable well servicing system for wells having a well casing and having a restriction therein and/or well tubing extending through the well casing to a desired location therein, comprising:

a guiding tool defining a tool receptacle having a collapsed position for running of said guiding tool through the restriction and/or well tubing and into the well casing and having a guiding position established within the well casing for subsequent guiding of well tools into said tool receptacle;

wherein said tool receptacle comprises a plurality of elongate guide fingers.

17. The re-enterable well servicing system of claim 16, further comprising:

running tubing for running and retrieving well tools and of a dimension permitting movement thereof through the restriction and/or well tubing; and a running tool connected with said running tubing and having releasable connection with said guiding tool.

18. The re-enterable well servicing system of claim 17, further comprising:

a forming member mounted to said running tool and having a forming surface thereon disposed in forming relation with said plurality of elongate guide fingers such that movement of said forming member relative to said plurality of elongate guide fingers causes movement of said plurality of elongate guide fingers from said collapsed position to said guiding position.

19. The re-enterable well servicing system of claim 18, wherein:

said forming member is linearly movable relative to said plurality of elongate guide fingers;

said forming surface of said forming member is a tapered swage surface reacting with said plurality of elongate guide fingers during linear movement of said forming member; and said plurality of elongate guide fingers are integral with said guiding tool and have plastic hinge sections for localized bending responsive to said movement of said plurality of elongate guide fingers by said tapered swage surface during said linear movement of said forming member.

20. The re-enterable well servicing system of claim 17, further comprising:

said guiding tool defining an internal latch receptacle; and a collet member linearly movable by said running tool and having a plurality of movable collet members disposed for latching engagement within said internal latch receptacle and being releasable from said internal latch receptacle.

21. The re-enterable well servicing system of claim 20, further comprising:

an annular force control rib located within said internal latch receptacle and defining a gradually tapered surface and an abruptly tapered surface; and wherein said movable collet members are elongate flexible collet fingers each having terminal ends defining a gradually tapered surface and an abruptly tapered surface, during insertion movement of said collet fingers into latching assembly within said internal latch receptacle, said gradually tapered surfaces of said annular force control rib and said terminal ends of said collet fingers flexing said collet fingers upon application of a predetermined collet assembly force and upon extraction movement of said collet fingers from latching engagement within said internal latch receptacle, said abruptly tapered surfaces of said annular force control rib and said terminal ends of said collet fingers flexing said collet fingers to collet release positions upon application of a predetermined collet release force exceeding said predetermined collet assembly force.

22. The re-enterable well servicing system of claim 17, further comprising:

said guiding tool defining an internal latch receptacle; and a collet member linearly movable by said running tool and having a plurality of movable collet members disposed for latching engagement within said internal latch receptacle and being releasable from said internal latch receptacle;

said running tool having a tool housing;

a mounting member releasably secured within said tool housing; and a collet control member extending from said mounting member and having a locking position retaining said plurality of movable collet members against releasing movement and a releasing position permitting releasing movement of said movable collet members.

23. The re-enterable well servicing system of claim 22, further comprising:

said mounting member defining a flow passage and a seat surface;

at least one shear pin releasably securing said mounting member within said tool housing; and a closure ball member being positioned on said seat surface and closing said flow passage; and with said closure ball member positioned on said seat surface, application of predetermined pressure from said running tubing developing sufficient pressure responsive force on said mounting member for shearing of said shear pin, thus releasing said mounting member for pressure responsive movement of said collet control member from said locking position to said releasing position and permitting guide finger movement to said guiding position.

24. The re-enterable well servicing system of claim 23, further comprising:

a retainer member mounted to said running tool and with said at least one shear pin releasably securing said mounting member within said tool housing said retainer member retaining said plurality of elongate guide fingers at said collapsed position thereof; and upon guide finger forming movement of a forming mandrel said retainer member being retracted from retaining relation with said plurality of elongate guide fingers.

25. The re-enterable well servicing system of claim 17, further comprising:

said running tool having at least one fluid circulation port permitting fluid to continuously flow through said running tubing and said running tool and into the annulus between said running tool and the well casing during running of said guiding tool into the well.

26. The re-enterable well servicing system of claim 16, further comprising:

an anchoring mechanism mounted to said guiding tool and having a retracted position for running thereof through the restriction and/or well tubing and an anchoring position establishing anchoring engagement thereof within the well casing; and an anchor actuating mechanism mounted to said anchoring mechanism and responsive to pressure induced force of fluid for actuating said anchoring mechanism from said retracted position to said anchoring position.

27. The re-enterable well servicing system of claim 26, wherein said anchoring mechanism comprises:

an anchor mandrel;

an anchor support member located at least partially within said anchor mandrel;

a first anchor actuator member retained in releasable assembly with said anchor mandrel and upon being released therefrom being movable relative to said anchor mandrel and said anchor support member;

a second anchor actuator member supported by said anchor support member; and a plurality to two-bar anchoring linkages each connected with said first and second anchor actuator members and, upon movement of said first anchor actuator member toward said second anchor actuator member, said first anchor actuator member moving said plurality of two-bar anchoring linkages from said retracted position toward said anchoring position.

28. The re-enterable well servicing system of claim 27, further comprising:

at least one shear pin retaining said first anchor actuator in substantially immovable relation with said anchor mandrel and maintaining said first anchor actuator and said two-bar anchoring linkages at said retracted positions.

29. The re-enterable well servicing system of claim 27, further comprising:

said anchor mandrel and said anchor support member each being of tubular configuration and being disposed in annular spaced relation and defining a piston chamber in fluid pressure communication with fluid within said guiding tool; and a piston member located within said piston chamber and disposed in force transmitting relation with said first anchor actuator member and movable responsive to fluid pressure within said guiding tool and imparting anchoring movement to said plurality to two-bar anchoring linkages.

30. The re-enterable well servicing system of claim 29, further comprising:

a gravel pack screen assembly connected with said anchor support member and defining an internal production fluid chamber;

said anchor support member being of tubular configuration and establishing a flow passage therethrough which is in communication with said production fluid chamber of said gravel pack screen assembly;

a frangible pressure barrier located within said flow passage and preventing entry of gravel into said production fluid chamber of said gravel pack screen assembly during a gravel packing operation;

a washing and completion tool string run through the well tubing following a gravel packing operation and washing gravel from within said flow passage above said frangible pressure barrier; and a cutting muleshoe located on said washing and completion tool string and cutting through said pressure barrier to establish production communication of said production fluid chamber of said gravel pack screen assembly with said tool receptacle of said guiding tool.

31. The re-enterable well servicing system of claim 16, further comprising:

said guiding tool establishing at least a portion of a production fluid flow passage;

a frangible isolation barrier member located within said production flow passage and preventing fluid flow therethrough; and a completion tool string run through the restriction and/or well tubing following installation of said guiding tool and having a cutting muleshoe selectively actuated for cutting through said frangible isolation barrier member and completing a production fluid flow passage through said guiding tool and said completion tool string.

32. The re-enterable well servicing system of claim 31, said cutting muleshoe comprising:

a tubular support member extending from said completion tool string and defining a flow passage;

a tubular cutter member defined by said tubular support member and having a cutting end oriented for cutting through said frangible isolation barrier member;

a retainer member supported by said tubular support member; and a tubular outer bullnose member releasably positioned to cover a majority of said tubular support member and said tubular cutter member and releasably connected with said retainer member, said tubular outer bullnose member being released from said retainer member as said completion tool string enters said guiding tool.

33. The re-enterable well servicing system of claim 31, further comprising:

a tubular inner bullnose member releasably secured to said cutting muleshoe and covering the cutting end of said cutting muleshoe; and said tubular inner bullnose member being released from said cutting muleshoe during movement of said cutting end into cutting engagement with said frangible isolation barrier member.

34. The re-enterable well servicing system of claim 31, further comprising:

an inflate packer mounted to said completion tool string and being inflated for sealing with the well casing by inflation pressure applied to said completion tool string; and a relief valve exposed to said inflation pressure and opening responsive to predetermined inflation pressure and inflating said inflate packer, said relief valve maintaining said predetermined inflation pressure within said inflate packer upon decrease of inflation pressure below said predetermined inflation pressure.

35. The re-enterable well servicing system of claim 34, further comprising:

said completion tool string defining a flow passage through which packer inflation pressure is selectively applied;

said relief valve being of annular configuration and having spaced seals of differing diameter;

said packer inflation pressure from said flow passage of said completion tool string acting on said differential area and developing a resultant force tending to unseat and open said relief valve and communicate said inflation pressure into said inflate packer.

36. The re-enterable well servicing system of claim 34, further comprising:

a pressure compensator mechanism mounted to said completion tool string and having concentric internal and external walls defining an internal chamber exposed to said predetermined inflation pressure of said inflate packer;

a spring package having at least one spring located within said internal chamber;

a piston member movable within said internal chamber and sealed with respect to said concentric internal and external walls, said piston member disposed in force transmitting relation with said spring package and exposed to said predermined inflation pressure; and said piston member and said spring package establishing a yield force compensating for pressure changes due to pressure and temperature fluctuations and compensating for pressure changes due to formation pressure drawdown and protecting said inflate packer against damage by excess pressure differential.

37. The re-enterable well servicing system of claim 31, further comprising:

an internal latch profile defined within said guiding tool;

a fluid flow control mandrel connected within said completion tool string;

a collet member mounted to said completion tool string; and said collet member establishing releasable engagement with said internal latch profile.

38. A re-enterable well completion and production system for wells, comprising:

a guiding tool located within a well casing and having a well completion tool receptacle;

a well completion tool string having a portion thereof disposed for engagement within said guiding tool and having a flow passage through which production fluid is produced from a production interval and through which packer inflation pressure is conducted; and an inflate packer establishing sealing between said well completion tool string and the well casing.

39. The re-enterable well completion and production system of claim 38, further comprising:

a pressure compensating mechanism mounted to said well completion tool string and having a yield force establishing maximum pressure differential to which said inflate packer may be subjected.

40. The re-enterable well completion and production system of claim 39, further comprising:

said inflate packer being inflated for sealing with the well casing by inflation pressure applied through said flow passage of said completion tool string;

a relief valve exposed to said inflation pressure and opening responsive to predetermined inflation pressure and inflating said inflate packer, said relief valve maintaining said predetermined inflation pressure within said inflate packer upon decrease of inflation pressure below said predetermined inflation pressure; and said pressure compensating mechanism defining an internal chamber in communication with said inflation pressure via said relief valve.

41. The re-enterable well completion and production system of claim 40, further comprising:

said relief valve being of annular configuration and having spaced seals of differing diameter; and said packer inflation pressure from said flow passage of said completion tool string acting on said differential area and developing a resultant force opening said relief valve and communicating said inflation pressure into said inflate packer.

42. The re-enterable well completion and production system of claim 40, further comprising:

said pressure compensating mechanism having concentric internal and external walls defining said internal chamber being exposed to said predetermined inflation pressure of said inflate packer;

a spring package having at least one spring located within said internal chamber;

a piston member movable within said internal chamber and sealed with respect to said concentric internal and external walls, said piston member disposed in force transmitting relation with said spring package and exposed to said predermined inflation pressure; and said piston member and said spring package establishing a yield force compensating for pressure changes due to pressure and temperature fluctuations and compensating for pressure changes due to formation pressure drawdown and protecting said inflate packer against damage by excess pressure differential.

* * * * *

UNITED STATES PATENT AND TRADEMARK OFFICE

CERTIFICATE OF CORRECTION

PATENT NO. : 6,915,845 B2
APPLICATION NO. : 10/444818
DATED : July 12, 2005
INVENTOR(S) : Leising et al.

It is certified that error appears in the above-identified patent and that said Letters Patent is hereby corrected as shown below:

Title page, item (75) Inventors : Lawrence J. Leising, Missouri City, TX (US); Arthar M. Ali, Sugar Land, TX (US)

Should read as follows:

(75) Inventors : Lawrence J. Leising, Missouri City, TX (US); Athar M. Ali, Sugar Land, TX (US)

Signed and Sealed this

Twentieth Day of January, 2009

JON W. DUDAS
*Director of the United States Patent and Trademark Office*